US011859341B2

(12) United States Patent
Lee et al.

(10) Patent No.: US 11,859,341 B2
(45) Date of Patent: Jan. 2, 2024

(54) LAUNDRY TREATING APPARATUS AND METHOD FOR CONTROLLING THE SAME

(71) Applicant: LG Electronics Inc., Seoul (KR)

(72) Inventors: Manseok Lee, Seoul (KR); Sangho Cho, Seoul (KR); Yein Park, Seoul (KR)

(73) Assignee: LG Electronics Inc., Seoul (KR)

( * ) Notice: Subject to any disclaimer, the term of this patent is extended or adjusted under 35 U.S.C. 154(b) by 422 days.

(21) Appl. No.: 17/179,901

(22) Filed: Feb. 19, 2021

(65) Prior Publication Data

US 2021/0262149 A1 Aug. 26, 2021

(30) Foreign Application Priority Data

Feb. 20, 2020 (KR) ..... 10-2020-0021223

(51) Int. Cl.

| | |
|---|---|
| ***D06F 58/20*** | (2006.01) |
| ***D06F 58/45*** | (2020.01) |
| ***D06F 58/44*** | (2020.01) |
| ***D06F 58/02*** | (2006.01) |
| ***D06F 39/00*** | (2020.01) |
| ***D06F 101/20*** | (2020.01) |
| ***D06F 105/40*** | (2020.01) |
| ***D06F 58/10*** | (2006.01) |

(52) U.S. Cl.

CPC ..... *D06F 58/203* (2013.01); *D06F 39/008* (2013.01); *D06F 58/02* (2013.01); *D06F 58/206* (2013.01); *D06F 58/44* (2020.02); *D06F 58/45* (2020.02); *D06F 58/10* (2013.01); *D06F 2101/20* (2020.02); *D06F 2105/40* (2020.02)

(58) Field of Classification Search

CPC ..... D06F 58/203; D06F 58/45; D06F 58/44; D06F 58/02; D06F 58/26; D06F 58/10; D06F 2101/20; D06F 2105/40; D06F 39/008

USPC ..... 34/597

See application file for complete search history.

(56) References Cited

U.S. PATENT DOCUMENTS

| | | | | |
|---|---|---|---|---|
| 4,263,258 A * | 4/1981 | Kalasek | A61L 2/24 | 422/26 |
| 5,546,678 A * | 8/1996 | Dhaemers | F26B 21/02 | 34/224 |
| 7,325,330 B2 * | 2/2008 | Kim | D06F 58/44 | 34/407 |

(Continued)

FOREIGN PATENT DOCUMENTS

| | | |
|---|---|---|
| CN | 1880542 | 12/2006 |
| CN | 201169701 | 12/2008 |

(Continued)

OTHER PUBLICATIONS

Extended European Search Report in European Appln. No. 21158185.5, dated Jul. 19, 2021, 8 pages.

(Continued)

*Primary Examiner* — Stephen M Gravini
(74) *Attorney, Agent, or Firm* — Fish & Richardson P.C.

(57) ABSTRACT

The present disclosure relates to a laundry treating apparatus that is provided to supply steam into a drum accommodating laundry therein and to supply hot water or the steam to a region outside the drum to also sterilize the region outside the drum, and a method for controlling the same.

20 Claims, 14 Drawing Sheets

(56) References Cited

U.S. PATENT DOCUMENTS

| | | | | |
|---|---|---|---|---|
| 7,921,578 | B2 * | 4/2011 | McAllister | D06F 35/00 34/597 |
| 7,997,006 | B2 * | 8/2011 | Son | D06F 58/44 8/149.1 |
| 8,865,087 | B2 * | 10/2014 | Buczynski | A61L 2/07 422/292 |
| 9,427,484 | B1 * | 8/2016 | Alvarado | D06B 23/18 |
| 11,513,478 | B2 * | 11/2022 | Kim | G05B 13/027 |
| 2011/0277334 | A1 | 11/2011 | Lee et al. | |
| 2021/0262149 | A1 * | 8/2021 | Lee | D06F 58/45 |
| 2023/0087630 | A1 * | 3/2023 | Choe | A61L 2/07 8/137 |
| 2023/0089461 | A1 * | 3/2023 | Byoun | D06F 58/45 8/137 |

FOREIGN PATENT DOCUMENTS

| | | | | |
|---|---|---|---|---|
| CN | 102869826 | | 1/2013 | |
| CN | 106319865 | | 1/2017 | |
| CN | 107687079 | | 2/2018 | |
| EP | 2933367 | | 10/2015 | |
| EP | 3868943 | A1 * | 8/2021 | D06F 39/008 |
| KR | 1020080056500 | | 6/2008 | |
| WO | WO2006112611 | | 10/2006 | |

OTHER PUBLICATIONS

Office Action in Chinese Appln. No. 202110191760.5, dated Oct. 31, 2022, 21 pages (with English abstract).

* cited by examiner

LAUNDRY TREATING APPARATUS AND METHOD FOR CONTROLLING THE SAME

CROSS-REFERENCE TO RELATED APPLICATION

This application claims the benefit of Korean Patent Application No. 10-2020-0021223, filed on Feb. 20, 2020, which is hereby incorporated by reference as when fully set forth herein.

TECHNICAL FIELD

The present disclosure relates to a laundry treating apparatus and a method for controlling the same.

BACKGROUND

In recent years, a laundry treating apparatus that performs a drying process capable of removing moisture from laundry has appeared. A conventional laundry treating apparatus was able to not only drastically shorten a drying time of the laundry by supplying hot air to a drum accommodating the laundry therein, but also sterilize and disinfect the laundry.

In such laundry treating apparatus, as the drying process is performed and the laundry is dried, an amount of the moisture removed from the laundry increases. Therefore, the conventional laundry treating apparatus has adapted a method for discharging the moisture generated in the process of drying the laundry to the outside together with air, or condensing the moisture and discharging the condensed moisture to the outside through a separate drain pipe.

In one example, in recent years, the laundry treating apparatus that performs the drying process also includes a conventional laundry treating apparatus that supplies steam to the laundry to remove wrinkles therefrom, improve a drying efficiency, or perform sterilization or the like. See Korean Patent Application Publication No. 10-2008-0056500.

(a) and (b) in FIG. 1 show the conventional laundry treating apparatus.

Referring to (a) in FIG. 1, the laundry treating apparatus may include a cabinet 1 forming an appearance of the apparatus, and a door 112 opening and closing the cabinet at the front, and may include a water supplier 300 disposed to be exposed to the outside at one side of the cabinet 1.

The water supplier 300 may be provided to store water therein to supply the steam in the drying process.

Referring to (b) in FIG. 1, a laundry treating apparatus of the present disclosure includes a steam supplier 200 disposed inside the cabinet 1 and receiving water from the water supplier 300 to generate the steam. The steam generated by the steam supplier 200 may be supplied through a steam supply pipe 230 to a drum 2 accommodated in the cabinet 1 to accommodate the laundry therein.

Because the steam supply pipe 230 is not able to be directly coupled to the rotating drum, the steam supply pipe 230 is generally connected to a portion at the rear or in front of the drum, or to a duct in communication with the drum. Accordingly, the steam may be supplied into the drum during the process of removing the wrinkles from the laundry or sterilizing the laundry separately during the drying process.

In such laundry treating apparatus, as the drying process is performed and the laundry is dried, the amount of the moisture removed from the laundry increases. Therefore, the conventional laundry treating apparatus has adapted the method for discharging the moisture generated in the process of drying the laundry to the outside together with the air, or condensing the moisture and discharging the condensed moisture to the outside through the separate drain pipe.

However, when the moisture is immediately discharged with the air, there was a problem of rapidly changing a humidity or a temperature of an indoor space in which the laundry treating apparatus is disposed. In addition, when the moisture is discharged by being condensed into water, there was a limitation that the laundry treating apparatus is installed only in a place where a sewer or the like is installed.

In recent years, in order to solve the above problems, a laundry treating apparatus having a water storage capable of separately storing the condensed water therein has appeared. Korean Patent Application Publication No. 10-2018-0045253.

When air discharged from the drum is cooled in the heat pump system, the water discharged from the laundry is condensed. The laundry treating apparatus collected the condensed water in the water storage, and then, separately collected the collected water in a separate water storage tank or used the collected water to wash the heat pump system.

Accordingly, the laundry treating apparatus has an advantage of being able to be installed in a living room or a room where the sewer or the like is not disposed, and has an advantage of not changing environmental conditions of the space where the laundry treating apparatus is installed because the moisture stored in the water storage is not randomly discharged to the outside.

However, the laundry treating apparatus does not have a steam supplier capable of supplying the steam to the drum and a steam tank for storing water supplied to the steam supplier therein. Therefore, when the steam supplier is installed, there is a problem in that a technical suggestion on how to supply the water to the steam supplier is not able to be provided.

As a result, in the conventional laundry treating apparatus that performs the drying process, the condensate generated in the process of drying the laundry has no choice but to remain inside the cabinet for a certain period of time, and the water for generating the steam has no choice but to be stored inside the cabinet when the steam supplier 200 is disposed.

As such, the water remaining inside the cabinet may increase a humidity inside the cabinet. Thus, in some cases, there was a problem that bacteria may propagate and contaminate the interior of the cabinet.

Even when a separate sterilization mode for sterilizing the interior of the drum 2 is equipped, the condensate and the steam supply water are not affected by the sterilization mode because those are arranged in a region between an outer face of the drum and the cabinet. Therefore, there was a possibility that the condensate and the steam supply water may still be decayed.

In one example, a laundry treating apparatus that may use the condensate collected in the water storage for the steam supply has appeared. See European Patent Application Publication No. 1887127 and No. 1862584.

Referring to (c) in FIG. 1, a laundry treating apparatus may include a cabinet 1 forming an appearance of the apparatus, a drum 16 that is rotatably disposed inside the cabinet and accommodates the laundry therein, and a condensation tank 8 for collecting water condensed from the drum 16. A hot air supplier 2 capable of supplying hot air to the drum 16 may be disposed below the drum 16.

The laundry treating apparatus may have a steam supplier that supplies the steam to the drum 16, and may further include a steam tank 3 that supplies water for generating steam by the steam supplier.

The steam supplier (not shown) may be provided to generate the steam by communicating with the steam tank 3, and may be disposed in the hot air supplier 2.

The steam tank 3 may be in communication with the condensation tank 8 via a communication pipe, and the communication pipe may have a filter. Accordingly, the steam tank 3 may be provided to receive the water collected in the condensation tank 8 that is filtered.

Therefore, the laundry treating apparatus has an advantage of being able to automatically supply the moisture to the steam tank 3 whenever the drying process is performed. As a result, the laundry treating apparatus does not need to be installed adjacent to the water supplier or a drainage, so that the laundry treating apparatus may be installed anywhere in the home.

However, because of only focusing on that the water to supply the steam may be sufficiently provided with only the condensate, the laundry treating apparatus has the steam tank 3 fixed to the cabinet.

That is, there was a problem that only the condensation tank 8 is provided to be withdrawn forwardly of the cabinet 1 to discharge the condensate in the condensation tank 8, and a possibility of withdrawal of the steam tank 3 to the outside is completely excluded.

Therefore, when the sufficient water is not supplied to supply the steam to the steam tank 3, such as when a sufficient amount of water is not condensed from the laundry, there was a limitation in that the process of supplying the steam is not able to be performed.

In addition, there was a limit that a user has no choice but to indirectly supply the water to the condensation tank 8 in order to supply the water to the steam tank 3.

In particular, because the condensation tank 8 is a space in which the condensate is stored, foreign matters such as lint or the like discharged from the laundry may be dissolved in the condensate, and there may be a concern that bacteria and the like may propagate due to long-term storage.

Nevertheless, the user was forced to generate the steam only with the condensate collected in the condensation tank 8.

In addition, even when the user wants to wash or sterilize the steam tank 3, there was no way to do this.

In addition, even when the user wants to generate the steam with fresh water such as direct water, such laundry treating apparatus was not able to reflect the intention of the user at all.

In addition, all of the aforementioned laundry treating apparatuses had a fundamental limitation in that those are not able to wash or sterilize the space between an inner face of the cabinet and the outer face of the drum at all. In other words, there was a problem in that there is no structure of washing the space outside the drum and there is no device that receives a command for washing the space outside the drum.

For example, the conventional laundry treating apparatuses such as those in (a) and (c) in FIG. 1 may all include a control panel 17 on the cabinet 1.

A display may be included in the control panel 17, and the display may be configured as a touch panel.

Therefore, the display may basically include a function input unit 119 that causes the laundry treating apparatus to perform additional functions such as remote control or reservation setting, shelf drying, and the like, a state display 119A that displays a remaining process time or a state of the laundry treating apparatus, a special input unit 119B that causes a condenser care of washing a heat-exchanger of the laundry treating apparatus, a wrinkle prevention of preventing the wrinkles in the laundry, and a specified command of the user to be performed, an option selection unit 119C that adjusts a strength or the number of times of the drying course, and the like. In this connection, a steam supplier 180 that inputs a command for generating the steam may be included, but the steam supplier 180 is only for supplying the steam into the drum.

That is, because the conventional laundry treating apparatus is not provided to sterilize an arbitrary region outside the drum or inside the cabinet, the conventional laundry treating apparatus was not provided to receive a separate sterilization command.

Furthermore, the conventional laundry treating apparatus had a problem of being able to burst as the condensate is frozen in winter.

In addition, the conventional laundry treating apparatus only cleans the heat-exchanger, but is not able to sterilize the heat-exchanger, thereby incapable of preventing the propagation of the bacteria.

SUMMARY

The present disclosure aims to provide a laundry treating apparatus that may supply steam or hot water not only into a drum, but also to the outside of the drum.

The present disclosure aims to provide a laundry treating apparatus that may sterilize a space defined between a cabinet and an outer face of the drum.

The present disclosure aims to provide a laundry treating apparatus that may sterilize an interior of the cabinet as well as supply the steam to the drum using a steam generator that generates the steam.

The present disclosure aims to provide a laundry treating apparatus that may sterilize condensate or a heat-exchanger with the steam generator.

The present disclosure aims to provide a laundry treating apparatus that prevents a rotation of the drum from being interfered when sterilizing an exterior of the drum.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

The present disclosure provides a laundry treating apparatus that may supply heat or steam not only into a drum but also to the outside of the drum to sterilize a region between an inner face of a cabinet and an outer face of a drum.

Typically, a heat-exchanger that condenses air discharged from the drum is exposed to a large amount of moisture. Therefore, the laundry treating apparatus of the present disclosure may directly sterilize the heat-exchanger by supplying high-temperature water or the steam to the heat-exchanger.

In addition, the laundry treating apparatus of the present disclosure may prevent bacteria from proliferating in advance by supplying the high-temperature water or the steam to a water collector in which the water condensed in the heat-exchanger is collected.

A pump may be disposed in the water collector, and the pump may be provided to deliver the condensate to a water storage that collects the condensate therein, or to re-supply the condensate to wash the heat-exchanger. The laundry treating apparatus of the present disclosure may sterilize not only the water storage but also the heat-exchanger by supplying the high-temperature water or the steam to the pump.

The region between the inner face of the cabinet and the outer face of the drum may be vulnerable to the moisture because a control line and a plurality of electronic products may be installed therein. In addition, when the condensate is sterilized, the steam may not deliver sufficient heat. In consideration of this, the laundry treating apparatus of the present disclosure may be provided to sterilize an interior of the cabinet only with the high-temperature water.

The high-temperature water may be supplied from a steam generator that generates the steam, and the steam generator may have a bypass pipe capable of separately discharging the high-temperature water, not the steam.

In one example, there is a need to sterilize the region outside the drum or an outer wall of the drum. In this case, it is not desirable to directly supply the high-temperature water. Accordingly, a sterilization nozzle that supplies the high-temperature water or the steam may be disposed inside the cabinet, and the sterilization nozzle may be provided to receive the high-temperature steam to sterilize the space outside the drum. In this case, an operation of an electronic product vulnerable to the moisture may be stopped, and the air or the moisture inside the cabinet may be controlled to be discharged to the outside with a separate fan after the steam is supplied.

In one example, in order to sterilize the region outside the drum, the laundry treating apparatus of the present disclosure has a sterilizer that receives the steam from the steam generator. Because the sterilizer is disposed in the region outside the drum, the sterilizer should not interfere with a rotation of the drum. Accordingly, in the sterilizer, a hose that receives the water, a hose that discharges the water, and valves that respectively open and close the hoses must be arranged to be spaced apart from the outer wall of the drum.

It is preferable that, in the sterilizer, all of the hoses that supply the water and discharge the water are fixed to an inner wall of the cabinet or an inner wall of a duct.

In addition, the hose that supply the water or discharge the water may be disposed in a region between a front or rear portion of the drum and the cabinet.

It is preferable that, in the sterilizer, the sterilization valve that controls the hose that supplies the water is disposed adjacent to the inner wall of the cabinet. Therefore, it may be possible to induce all of the hoses that supply the water and discharge the water to be located on the inner wall of the cabinet, and the rotation of the drum may not be interfered.

In one example, in order to separately drive the sterilizer, a sterilization input unit that supplies the high-temperature water or the steam to the sterilizer to sterilize the region between the outer face of the drum and the inner face of the cabinet may be disposed on a control panel of the laundry treating apparatus.

When the sterilization input unit receives an input, the water or the steam heated by a steam supplier may be directly supplied into a space requiring sterilization defined between the outer face of the drum and the inner face of the cabinet without the heat-exchanger or the rotation of the drum.

In addition, the high-temperature water or the steam may be controlled to be automatically supplied from the sterilizer to the space requiring the sterilization after a drying process is performed.

The present disclosure has an effect of supplying steam or hot water not only into a drum but also to the outside of the drum.

The present disclosure has an effect of sterilizing a space defined between a cabinet and an outer face of the drum.

The present disclosure has an effect of not only supplying the steam to the drum, but also sterilizing an interior of the cabinet with a steam generator that generates the steam.

The present disclosure has an effect of being able to sterilize condensate or a heat-exchanger with the steam generator.

The present disclosure has an effect of preventing a rotation of the drum from being interfered when sterilizing the region outside the drum.

In addition to the effects as described above, specific effects of the present disclosure will be described together with the detailed description for carrying out the disclosure.

DETAILED DESCRIPTION

Figure 1:
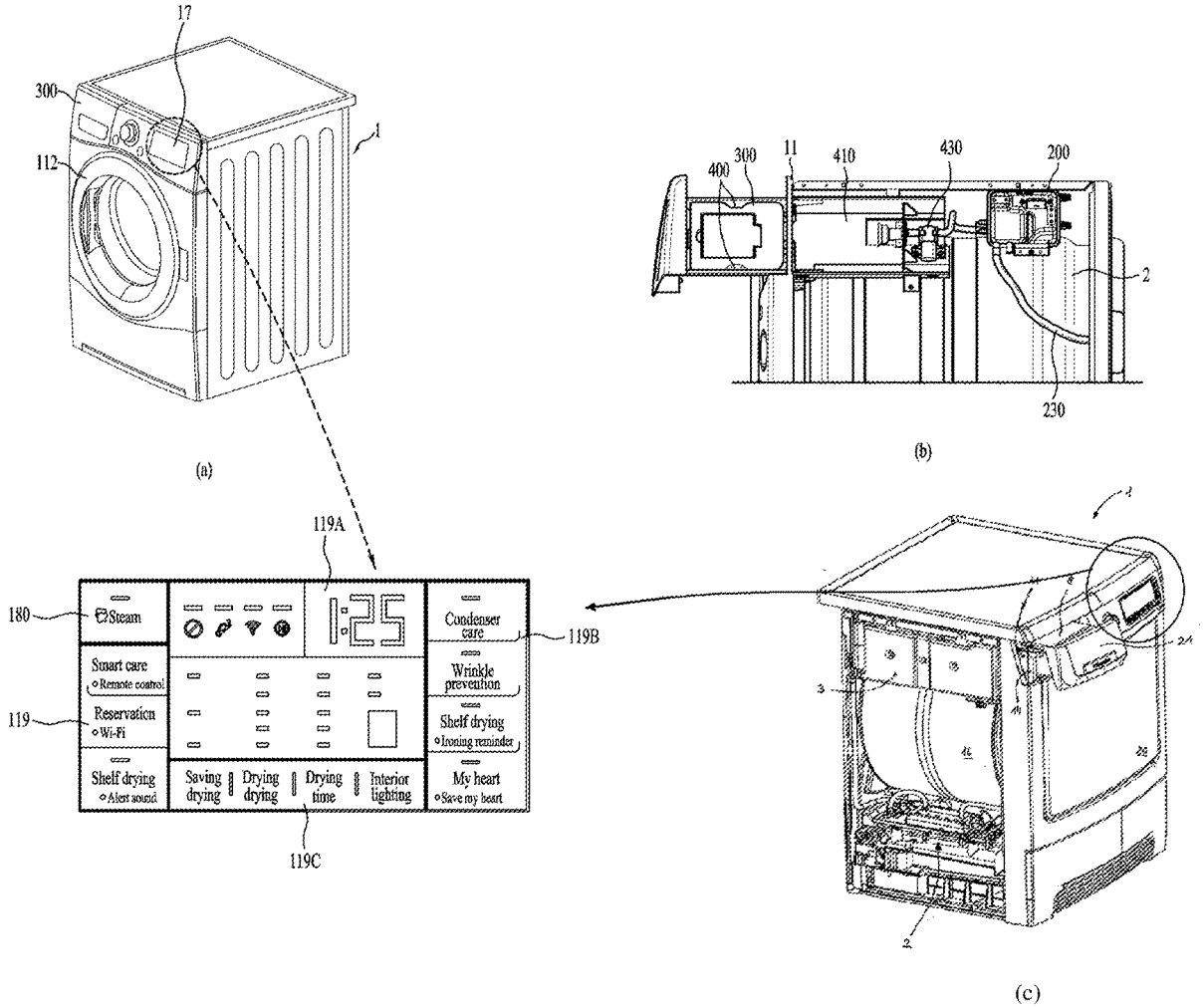
FIG. 1 shows a structure of a conventional laundry treating apparatus.

For simplicity and clarity of illustration, elements in the figures are not necessarily drawn to scale. The same reference numbers in different figures denote the same or similar elements, and as such perform similar functionality. Furthermore, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" a second element or layer, the first element may be disposed directly on the second element or may be disposed indirectly on the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

Further, as used herein, when a layer, film, region, plate, or the like is disposed "on" or "on a top" of another layer, film, region, plate, or the like, the former may directly contact the latter or still another layer, film, region, plate, or the like may be disposed between the former and the latter. As used herein, when a layer, film, region, plate, or the like is directly disposed "on" or "on a top" of another layer, film, region, plate, or the like, the former directly contacts the latter and still another layer, film, region, plate, or the like is not disposed between the former and the latter. Further, as used herein, when a layer, film, region, plate, or the like is disposed "below" or "under" another layer, film, region, plate, or the like, the former may directly contact the latter or still another layer, film, region, plate, or the like may be disposed between the former and the latter. As used herein, when a layer, film, region, plate, or the like is directly disposed "below" or "under" another layer, film, region, plate, or the like, the former directly contacts the latter and still another layer, film, region, plate, or the like is not disposed between the former and the latter.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferred embodiments of a laundry treating apparatus and a method for controlling the same will be described in detail with reference to the accompanying drawings. A configuration or a control method of the apparatus to be described below is only for describing an example of the laundry treating apparatus and the method for controlling the same, and is not intended to limit the scope of the invention. In addition, reference numerals used identically throughout the specification represent the same components.

Figure 2:
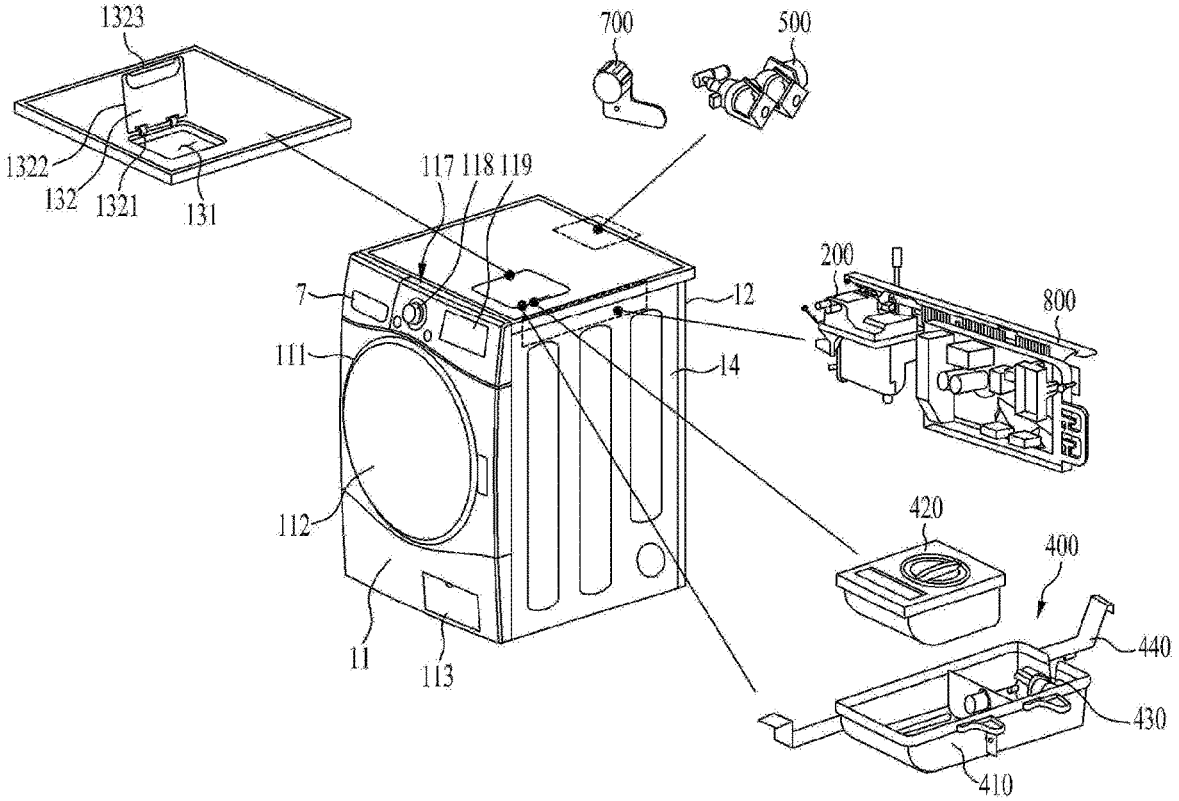
FIG. 2 shows features of a laundry treating apparatus of the present disclosure.

FIG. 2 shows basic features of a laundry treating apparatus of the present disclosure.

As shown in FIG. 2, a cabinet 1 includes a front panel 11 defining a front face of the laundry treating apparatus. The front panel has an inlet 111 defined therein to communicate with a drum 2 and a door 112 12 pivotally coupled to the cabinet to open and close the inlet 111.

A control panel 117 is disposed on the front panel 11. The control pane 117 may include an input unit 118 for receiving a control command from a user, and an display 119 for outputting information such as a control command selectable by the user. A main controller that controls a command for performing a drying process of the laundry treating apparatus may be installed.

The input unit may be configured to include a power supply request unit for requesting power supply to the laundry treating apparatus, a course input unit for allowing the user to select a desired course among a plurality of courses, and an execution request unit for requesting start of a course selected by the user. The display 119 may be configured to include at least one of a display panel capable of outputting a text and a figure, and a speaker capable of outputting an audio signal and a sound.

In one example, the laundry treating apparatus of the present disclosure may include a water storage 7 provided to separately store therein moisture generated in the process of drying the laundry. The water storage 7 may include a storage body 72 provided to be withdrawn from one side of the front panel 11 to the outside. The storage body 72 may be provided to collect condensate delivered from a washing pump to be described later. The user may withdraw the storage body 72 from the cabinet 1 to remove the condensate therefrom, and then, mount the storage body 72 in the cabinet 1 again. Therefore, the laundry treating apparatus of the present disclosure may be placed in any places where a sewer or the like is not installed.

In one example, the laundry treating apparatus of the present disclosure may further include a steam supplier 200 capable of supplying steam to the laundry or into the cabinet. The steam supplier 200 may be provided to generate the steam by receiving fresh water rather than the condensate.

The steam supplier 200 may be provided to generate the steam by heating the water, using ultrasonic waves, or vaporizing the water.

Because the steam supplier 200 is provided to generate the steam by receiving a certain amount of water, the steam supplier 200 may occupy a certain volume. In this connection, the door and the control panel 117 are installed on the front panel 11 of the cabinet, and a duct that supplies or discharges air to/from the drum, a water supply, and the like may be installed on the rear panel 12 of the cabinet, so that the steam supplier 200 may be advantageously installed on the side panel 14 of the cabinet.

In addition, the laundry treating apparatus of the present disclosure may include a steam controller 800 provided to separately control the steam supplier 200. The steam controller 800 may be installed on the control panel 117, but may be provided as a separate control panel to prevent overloading of the control panel 117 and to prevent increase a production cost.

The steam controller 800 may be disposed adjacent to the steam supplier 200. The steam controller 800 may be disposed on the side panel 14 on which the steam supplier 200 is installed to reduce a length of a control line or the like connected to the steam supplier 200.

Because the steam supplier 200 supplies the steam that may contact the laundry, it is preferable to generate the steam with the fresh water. Because the water collected in the water storage 7 is generated from the laundry, there is a high possibility that lint or foreign matters are contained in the water collected in the water storage 7. Thus, the water collected in the water storage 7 may not be suitable for generating the steam.

Accordingly, the laundry treating apparatus of the present disclosure may supply the water to the steam supplier 200, but may include a water supplier 300 provided separately from the water storage 7. The water supplier 300 may be provided to store the fresh water therein, or receive the fresh water from the outside and supply the fresh water to the steam supplier 200.

For example, the water supplier 300 may include an external water supplier 500 that may receive water from an external water supply source and deliver the water to the steam supplier 200, and an internal water supplier 400 that may separately store the fresh water therein and supply the fresh water to the steam supplier 200.

The internal water supplier 400 may further include a water tank 420 that is provided separately from the water storage 7 to store the fresh water therein, a water pump 430 provided to supply the water in the water tank 420 to the steam supplier 200, and a tank housing 410 that seats the water tank 420 and the water pump 430 inside the cabinet.

The laundry treating apparatus of the present disclosure may also be provided such that the water tank 420 and the steam supplier 200 are installed at different vertical levels, so that the water in the water tank 420 is supplied to the steam supplier 200 by a self load.

When the difference in the installation vertical level between the water tank 420 and the steam supplier 200 is not secured, it may be desirable to additionally install the water pump 430. In addition, when the water pump 430 is additionally disposed, there is an advantage in that a space inside the cabinet 1 may be more densely utilized.

The external water supplier 500 may include a direct water valve 520 connected to the external water supply source to receive the water.

In addition, the laundry treating apparatus of the present disclosure may further include a determination unit 700 that determines whether to supply the water to the steam supplier 200 by preferentially using which of the external water supplier 500 and the internal water supplier 400. The determination unit 700 may be structurally provided to determine which of the external water supplier 500 and the internal water supplier 400 is preferentially used.

In one example, the water tank 420 may be provided to store the fresh water therein. It is preferable that the water tank 420 is provided to be exposed to the outside of the cabinet 1 to be frequently filled with the fresh water.

However, because both the water tank 420 and the water storage 7 are provided to store the water therein, the user may be confused. To this end, the laundry treating apparatus of the present disclosure may be provided such that the water tank 420 and the water storage 7 are exposed from the cabinet in different directions and at different locations. For example, the water tank 420 may be provided to be exposed through the top panel 13, and the water storage 7 may be provided to be exposed through the front panel 11. Therefore, even when both the water tank 420 and the water storage 7 are arranged, the confusion of the user may be prevented.

The water tank 420 may have a relatively smaller volume than the water storage 7 because the water tank 420 must store the fresh water therein and a freshness of the stored water must be maintained. Accordingly, the user may distinguish the water tank 420 and the water storage 7 from each other by the volume difference.

Because the water tank 420 has the smaller volume than the water storage 7, the water tank 420 may be easily withdrawn upward. Accordingly, the water tank 420 may be provided to be withdrawn upward from the top panel 13. As a result, because the withdrawal directions of the water tank 420 and the water storage 7 are different from each other, the possibility of user confusion may be further reduced.

The top panel 13 of the laundry treating apparatus of the present disclosure may include a tank withdrawal hole 131 defined therein provided such that the water tank 420 may be exposed to the outside or the water tank 420 may be withdrawn to the outside of the cabinet. The tank withdrawal hole 131 may have a cross-sectional area corresponding to or slightly larger than a cross-sectional area of the water tank 420.

The top panel 13 may further include a withdrawal cover 132 provided to shield the tank withdrawal hole 131 to prevent the water tank 420 from being arbitrarily withdrawn. The withdrawal cover 132 may include one or more panel coupling portions 1321 provided to be coupled to an outer peripheral surface of the tank withdrawal hole 131. The panel coupling portion 1321 may extend from one side of the withdrawal cover 132 so as to pivotably couple the withdrawal cover 132 to the top panel 13. The panel coupling portion 1321 and the top panel 13 may be coupled to each other in a hinge coupling scheme.

In one example, the withdrawal cover 132 may have a panel handle 1323 that may be gripped by the user on a surface thereof, and the panel handle 132 may be defined as a groove that is concave downward from the withdrawal cover 132. In addition, the withdrawal cover 132 may further include a panel fixing portion 1332 detachably coupled to an outer peripheral surface of the top panel 13 or the tank withdrawal hole 131. The panel fixing portion 1332 may be coupled to the top panel 13 or the tank withdrawal hole 131 in a push button scheme.

The laundry treating apparatus of the present disclosure may further include a filter capable of removing foreign matters from circulating air. The front panel 11 may have a filter mounting hole 113 defined therein through which the filter is withdrawn or inserted.

Figure 3:
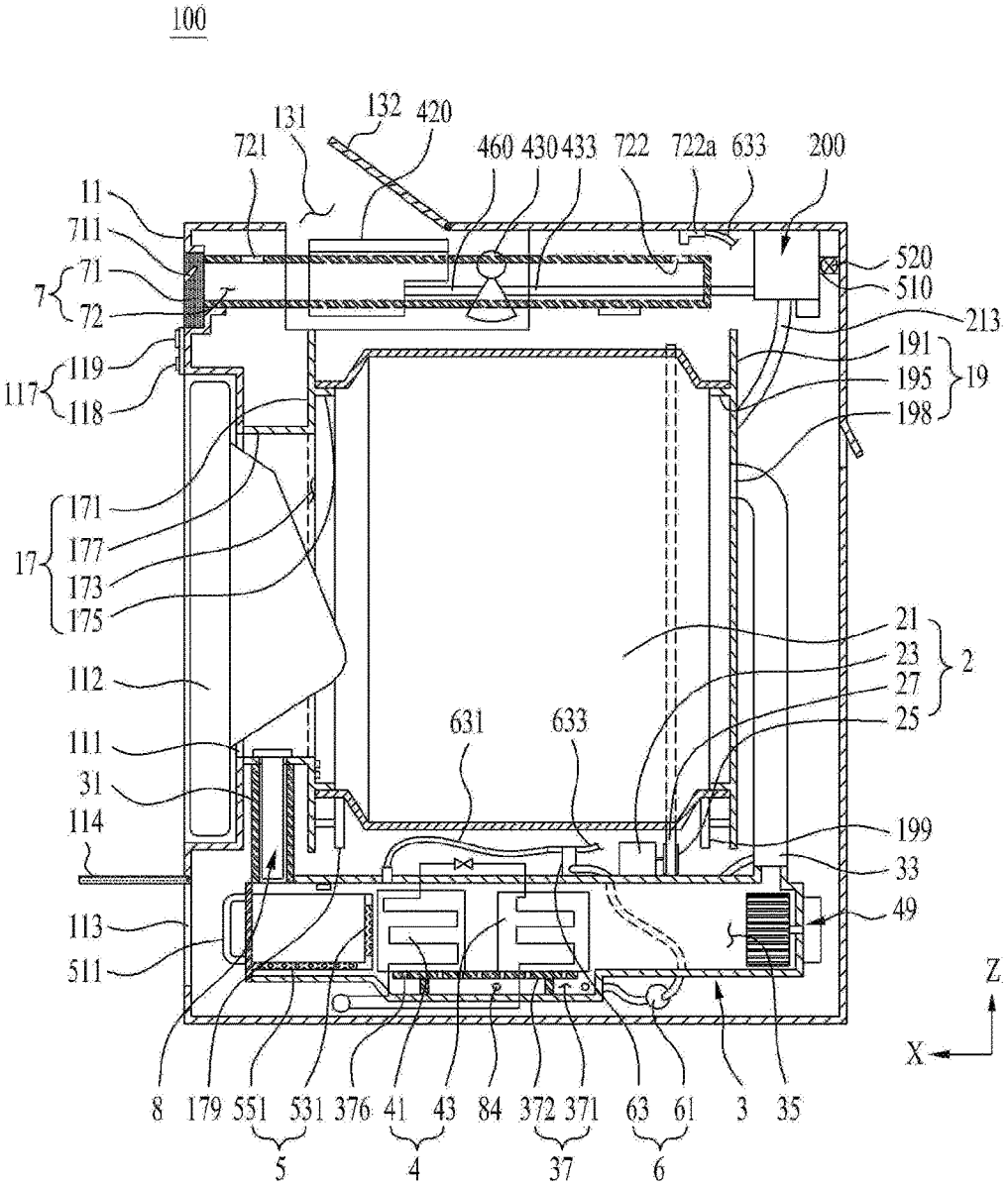
FIG. 3 shows an internal structure of a laundry treating apparatus of the present disclosure.

FIG. 3 shows an internal configuration of a laundry treating apparatus of the present disclosure.

As shown in FIG. 3, the laundry treating apparatus 100 includes a cabinet 1, a drum 2 rotatably disposed inside the cabinet to define therein a space for storing the laundry therein, and a circulating flow passage that defines a flow passage for re-supplying air discharged from the drum 2 to the drum 2, and a heat-exchanger 4 that dehumidifies and heats the air introduced into the circulating flow passage 3 and then re-supplies the dehumidified and heated air to the drum 2. When the drum 2 is provided as a cylindrical drum body 21 with an open front face and an open rear face, a first support 17 that rotatably supports the front face of the drum 2 to be rotatable, and a second support 19 that supports the rear face of the drum 2 to be rotatable may be arranged inside the cabinet 1.

The first support 17 may be configured to include a first fixed body 171 fixedly disposed inside the cabinet 1, a drum inlet 173 provided to extend through the first fixed body and communicating the inlet 112 and the inside of the drum body 21 with each other, and a first support body 155 disposed on the first fixed body 171 and inserted into the front face (a first open face) of the drum body 21.

The first fixed body 171 may have any shape as long as the drum inlet 173 may be defined therein and the first support body 175 may be disposed thereon. The first support body 175 may be formed in a pipe shape protruding from the first fixed body 171 toward the drum body 21. A diameter of the first support body 175 may be larger than a diameter of the drum inlet 173 and may be smaller than a front face diameter of the drum body 21. In this case, the drum inlet 173 may be located inside a space defined by the first support body 175.

The first support 17 may be provided to further include a connection body 177 for connecting the inlet 111 and the drum inlet 173 with each other. The connection body 177 may be formed in a shape of a pipe extending from the drum inlet 173 to the inlet 111. The connection body 177 may have an air discharge hole 178 defined therein that communicates with a duct 3. As shown in FIG. 3, the air discharge hole 178 is a flow passage along which air inside the drum body 21 may flow to the circulating flow passage 3, which may be embodied as a through-hole provided to extend through the connection body 177.

The second support 19 may be provided to include a second fixed body 191 fixedly disposed inside the cabinet 1, and a second support body 195 disposed on the second fixed body 191 and inserted into the rear face (a second open face) of the drum body 21. An air inlet 188 is defined in the second support 19 and extends through the second fixed body 191 and communicates the inside of the drum body 21 with the inside of the cabinet 1. In this case, the duct 3 may be provided to connect the air discharge hole 178 and the air inlet 198 to each other.

The drum body 21 in a hollow cylindrical shape may be rotated by various types of drivers. FIG. 3 shows a case in which a driver 28 includes a motor 23 fixedly disposed inside the cabinet 1, a pulley 25 rotated by the motor, and a belt 27 connecting a circumferential surface of the pulley 25 and a circumferential surface of the drum body 21 with each other as an example.

In this case, the first support 17 may have a first roller 179 that supports a circumferential surface of the drum body 21 to be rotatable, and the second support 19 may have a second roller 199 that supports the circumferential surface of the drum body to be rotatable.

The circulating flow passage 3 may include a duct along which the air inside the drum 2 may flow to the outside of the drum 2. The circulating flow passage 3 may be configured to include an air discharge duct 31 connected to the air discharge hole 178, an air supply duct 33 connected to the air inlet 198, and a connection duct 35 connecting the air discharge duct and the air supply duct to each other.

The heat-exchanger 4 may be embodied as various devices as long as the devices may sequentially perform dehumidification and heating of the air introduced into the circulating flow passage 3. For example, the heat-exchanger 4 may be embodied as a heat pump system.

The heat-exchanger 4 may include a fan 49 that moves air along the circulating flow passage 3, a first heat-exchanger (heat-absorber) 41 that removes moisture from the air introduced into the circulating flow passage 3, and a second heat-exchanger (heat-emitter) 43 which is disposed inside the circulating flow passage 3 and heats the air that has passed through the first heat-exchanger 41.

Figure 4:
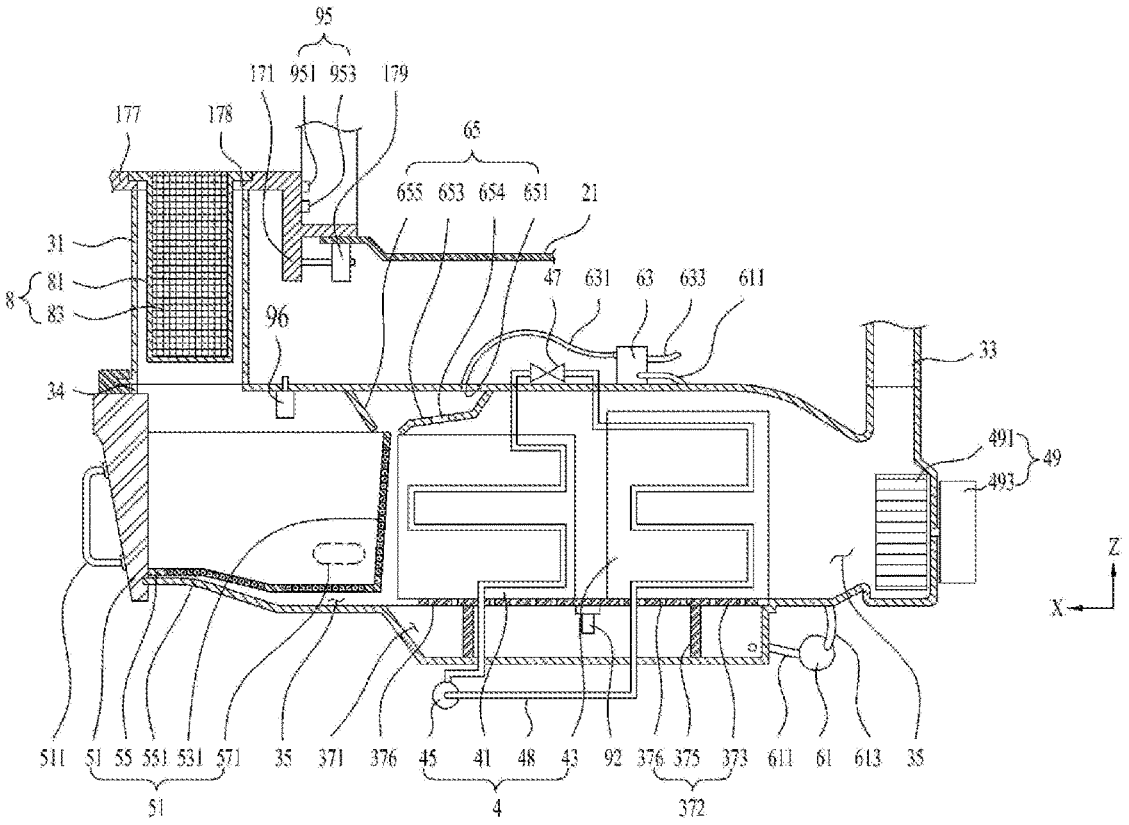
FIG. 4 shows a washer structure of a laundry treating apparatus of the present disclosure.

The fan 49 may be provided to include an impeller 491 disposed inside the circulating flow passage 3 and an impeller motor 493 rotating the impeller 491 (see FIG. 4). The impeller 491 may be disposed anywhere in the air discharge duct 31, the connection duct 35, and the air supply duct 33. FIG. 3 shows as an example a case in which the impeller 491 is disposed in the air supply duct 33 (a case in which the impeller 491 is located at the rear of the heat-emitter).

The heat-absorber 41 is embodied as a plurality of metal plates arranged along a width direction (a Y-axis direction) of the connection duct 35 or a plurality of metal plates arranged along a height direction (a Z-axis direction) of the connection duct. The heat-emitter 43 may be embodied as a plurality of metal plates arranged along a width direction of the connection duct or a height direction of the connection duct. The heat-absorber 41 and the heat-emitter 43 are sequentially arranged in the connection duct 35 in a direction from the air discharge duct 31 toward the air supply duct 33, and are connected to each other via a refrigerant pipe 48 which defines a circulating flow passage of a refrigerant (see FIG. 4).

The refrigerant moves along a refrigerant pipe 48 by a compressor 45 located outside the circulating flow passage 3. The refrigerant pipe 48 is equipped with a pressure regulator 47 that controls a pressure of the refrigerant that has passed through the heat-emitter 43.

The heat-absorber 41 may refer to means for cooling the air and evaporating the refrigerant by delivering the heat of the air flowing into the air discharge duct 31 to the refrigerant. The heat-emitter 43 may refer to means for heating the air and condensing the refrigerant by delivering the heat of the refrigerant passing through the compressor 45 to the air. In this case, moisture contained in the air may be collected on a bottom face of the connection duct 35 along a surface of the heat-absorber 41 as the air passes through the heat-absorber 41.

A water collector is disposed in the laundry treating apparatus 100 to collect the water removed from the air passing through the heat-absorber 41.

The water collected in the water collector may be collected in the water storage 7 and then be collectively discharged later. The water storage 7 may include a storage body 72 detachably disposed in the cabinet 1 to define therein a space for storing the water therein, and an inlet 722 provided to penetrate the storage body 72 to introduce the water discharged from the water storage supply pipe 633 into the storage body 72.

The storage body 72 may be provided as a drawer-shaped tank extended from the cabinet 1. In this case, the front panel 11 of the cabinet must have a water storage mounting hole defined therein into which the storage body 72 is inserted. A panel 71 is fixed to the front face of the storage body 72, The panel 71 may be provided to be detachably coupled to the water storage mounting hole to form a portion of the front panel 11.

A groove 711 into which a user's hand is inserted may be further defined in the panel 71. In this case, the panel 71 will also perform a function of a handle of extending the storage body 72 from the cabinet or retracting the storage body 72 into the cabinet.

The inlet 722 may be defined to receive the water discharged from a nozzle 722*a* fixed to the cabinet 1. The nozzle 722*a* may be fixed to the top panel 13 of the cabinet to be positioned above the inlet 722 when the storage body 72 is inserted into the cabinet 1.

The water storage 7 having the above-described structure may discard the water inside the storage body 72 by overturning or inclining the storage body 72 in a direction in which the inlet 722 is located after the user extends the storage body 72 from the cabinet 1. A communication hole 721 provided to penetrate a top face of the storage body 72 may be further defined such that the water inside the storage body 72 is easily discharged through the inlet 722.

The steam supplier 200 may be disposed to be spaced apart from the water storage 7. As described above, the steam supplier 200 may be provided to be connected to the internal water supplier 400 and an external water supplier 500 to receive the water to form the steam. The external water supplier 500 may include a direct water valve 520 adjacent to the rear panel 13 or fixed to the rear panel 13, and a direct water pipe 510 that supplies the water delivered from the direct water valve 520 to the steam supplier 200. The direct water valve 520 may be provided to be coupled to the external water supply source. For example, the direct water valve 520 may be coupled with a water supply pipe extending to the rear face of the cabinet. Therefore, the steam supplier 200 may be provided to receive the water directly through the direct water valve 520. Therefore, even when the internal water supplier 400 is omitted, or when the water is not stored in the internal water supplier 400, the steam supplier 200 may receive the water through the direct water valve 520 whenever necessary. The direct water valve 520 may be directly controlled by the steam controller 800.

In one example, the steam supplier 200 may be disposed adjacent to the direct water valve 520. Therefore, residual water may be prevented from remaining unnecessarily in the direct water pipe 510, and the water may be immediately supplied when necessary.

The internal water supplier 400 may include the water tank 420 for storing the water therein, the water pump 430 that may receive the water from the water tank 420 and supply the water to the steam supplier 200, and a tank housing 410 that defined therein a space for mounting the water tank 420 and the water pump 430 therein. The water pump 430 and the water tank 420 may be arranged at a vertical level corresponding to that of the steam supplier 200. The tank withdrawal hole 131 may be installed in a region of the top panel 13 corresponding to a portion where the water tank 420 is installed. Therefore, the water pump 430 may be prevented from being unnecessarily exposed through the tank withdrawal hole 131 as much as possible. The withdrawal cover 132 may be pivotably coupled to an outer circumferential surface of the tank withdrawal hole 131 to prevent the water tank 420 from being unnecessarily exposed to the outside.

The steam supplier 200 may receive the water through the water supplier 300 to generate the steam and then supply the water to the drum 2 or the circulating flow passage 3 through the steam discharge pipe 213. The steam discharge pipe 213 may directly communicate with the drum 2 to supply the steam into the drum 2, and may communicate with the circulating flow passage 3 or the second support 19 to indirectly supply the steam into the drum 2.

The steam discharge pipe 213 may be in communication with the air supply duct 33 when being connected to the circulating flow passage 3, and may be in communication with the air inlet 198 when being connected to the second support 19. Therefore, the steam may be more smoothly introduced into the drum 2 using a power of the blower fan 49.

The steam supplier 200 may be controlled to generate the steam when a steam supply mode using the steam is performed during the drying process. The steam supply mode may correspond to a series of drying courses of sterilizing the laundry, increasing a temperature inside the drum during the drying process of the laundry, or removing wrinkles from the laundry at the end of the drying process of the laundry. The steam supplier 200 may be controlled to receive the water from the external water supplier 500 as well as the internal water supplier 400 as necessary to supply the steam into the drum 2 or the like.

In one example, the heat-exchanger 4 is provided to condense the moisture of the air circulating in the heat-absorber 41. Therefore, even when the air circulates in the drum 2, because the moisture contained therein is removed by the heat-absorber 41, the air may continuously dry the laundry inside the drum 2.

The moisture condensed in the heat-absorber 41 may be collected primarily in the water collector 37 and then secondly collected in the water storage 7. The water collector 37 may be located inside the connection duct 35 and may be separately disposed in a space spaced apart from the connection duct 35.

FIGS. 3 and 4 show an embodiment in which the water collector 37 may be disposed inside the connection duct 35, but this is for illustration only. The water collector 37 may be have any structure as long as the water collector 37 is able to collect the condensate.

FIG. 4 shows detailed structures of the water collector 37, the heat-exchanger 4, the washer 6, and the like.

The water collector 37 may be embodied as a collector body 371 which is fixed to the bottom face of the connection duct 35 and communicates with the inside of the connection duct. To prevent the heat-absorber and the heat-emitter 41 and 43 from contacting the water (condensate) stored in the collector body 371, a heat-exchanger support 372 may be further disposed inside the collector body 371. The heat-exchanger support 372 may include a support plate 373 which the heat-absorber and the heat-emitter 41 and 43 contact, a spacer 375 that maintains a spacing between the support plate 373 and the bottom face of the collector body 371, and a support plate through-hole 376 provided to pass through the support plate 373.

The support plate through-hole 376 may be defined only in a portion of the support plate 373 on which the heat-absorber 41 is supported, or may be defined in portions thereof on which the heat-absorber 41 is supported and the heat-emitter is supported, respectively. When the support plate through-hole 376 is defined under the heat-emitter 43, water that has moved to the heat-emitter 43 along the support plate 373 may be discharged to the collector body 371 (thus, preventing decrease in heat transfer efficiency that occurs when the heat-emitter contacts the water).

In order to minimize accumulation of foreign matters (lint) discharged from the drum body 21 on the heat-absorber 41 and the heat-emitter 43, a filtration unit for filtering air may be further disposed in the laundry treating apparatus 100. FIG. 3 shows a case in which the filtration unit is provided as a first filtration unit 5 disposed in the connection duct 35 and a second filtration unit 8 disposed in the air discharge duct 31 as an example.

The second filtration unit 8 may be provided as means for filtering the air flowing into the air discharge duct 31 from the drum body 21, and the first filtration unit 5 may be provided as means disposed between the second filtration unit 8 and the heat-absorber 41 to filter the air that has passed through the second filtration unit. A diameter of a filtration hole defined in the first filtration unit 5 may be set smaller than a diameter of a filtration hole defined in the second filtration unit 8.

The second filtration unit 8 may include a frame 81 detachably inserted into the air discharge duct 31 through the air discharge hole 178, and a filter (a fourth filter) 83 disposed in the frame to filter the air The first filtration unit 5 may be detachably disposed in the connection duct 35. In this case, the front panel 11 of the cabinet may have a filter mounting hole 113 (see FIG. 1) through which the first filtration unit 5 is withdrawn and a mounting hole door 114 that opens and closes the filter mounting hole, and a duct through-hole 34 (see FIG. 3) into which the first filtration unit 5 is inserted may be defined in the circulating flow passage 3. Accordingly, the user may remove foreign matters remaining in the first filtration unit 5 and wash the first filtration unit after separating the first filtration unit 5 from the laundry treating apparatus when necessary.

The first filtration unit 5 may be provided to include filtration unit body 51, 53, 57, and 58 inserted into the filter mounting hole 113 and the duct through-hole 34 and positioned between the second filtration unit 8 and the heat-absorber 41, and filters 531, 551, and 571 arranged in the filtration unit body to filter fluids (the air and the water) flowing to the heat-absorber 41 and collector body 371.

The filtration unit body may be in various shapes based on a shape of a cross-section (a Y-Z plane and a X-Z plane) of the connection duct 35. FIG. 1 shows a case in which the filtration unit body is in a shape similar to a hexahedron.

In this case, the filtration unit body may include a front face 51 in a shape capable of closing the duct through-hole 34, a rear face 53 positioned between the front face and the heat-absorber 41, a bottom face 55 provided to connect the front face with the rear face, and a first side face 57 and a second side face 58 respectively forming left and right faces of the filtration unit body.

The front face 51 may have a lock 513 disposed thereon detachably coupled to a lock fastener 16 disposed on the cabinet. The lock 513 may be provided as a bar pivotably coupled to the front face 51 of the filtration unit body, and the lock fastener 16 may be provided to define a groove in which a free end of the bar is received. Preferably, each lock 513 is disposed on each of opposite sides of the front face 51, and each lock fastener 16 is disposed on each of opposite sides of the filter mounting hole 113.

A handle 511 may be further disposed on the front face 51 to facilitate inserting the filtration unit body into the connection duct 35 or separating the filtration unit body from the connection duct 35.

A first filter 531 and a second filter 551 for filtering the fluids (the air and the water) introduced into the filtration unit body may be respectively arranged on the rear face 53 and the bottom face 55. The rear face 53 has a rear face through-hole defined therein that communicates an interior of the filtration unit body with an internal space of the circulating flow passage 3, and the first filter 531 is disposed in the rear face through-hole. The bottom face 55 has a bottom face through-hole defined therein that communicates the interior of the filtration unit body with the internal space of the circulating flow passage 3, and the second filter 551 is disposed in the bottom face through-hole. Therefore, the first filter 531 becomes means for filtering the fluids (the air and the water) supplied to the heat-absorber 41, and the second filter 551 becomes means for filtering the fluids supplied to the collector body 371.

The first side face 57 and the second side face 58 may be provided to connect the front face 51, the rear face 53, and the bottom face 55 with each other.

The first filtration unit 5 having the above-described structure may be provided to communicate with the air discharge duct 31 through the top face or the second side face 58 of the filtration unit body. The first filtration unit 5 may be connected to the air discharge duct 31 through a top face through-hole provided to penetrate the top face of the filtration unit body and a side through-hole provided to penetrate the second side face 58.

The first filter 531 may be provided to be inclined at 90 degrees to 100 degrees toward a front face of the heat-absorber 41 with respect to the bottom face 55 of the filtration unit body. This is to allow foreign matters remaining in the first filter to easily move to the bottom face 55 when the water is sprayed on the first filter 531 through a washer 6 to be described later.

The second filter 551 may be provided to be inclined downward by 10 to 20 degrees from the front face 51 toward the first filter 531 (The second filter may be provided to be inclined upward by 10 to 20 degrees in a direction in which the filter mounting hole is located from a bottom of the first filter). When the second filter 551 is provided to be inclined downward toward the first filter 531, because a connection point of the first filter 531 and the second filter 551 will be the lowest point in the space defined in the first filtration unit, the foreign matters of the first filtration unit 5 may be concentrated at the connection point of the first filter 531 and the second filter 551. When the foreign matters are concentrated at the connection point of the first filter 531 and the second filter 551, the user will be able to more easily remove the foreign matters inside the first filtration unit 5.

However, when the foreign matters are concentrated at the connection point of the first filter 531 and the second filter 551, the water sprayed through the washer 6 may be discharged to the collector body 371, which requires a long time. In order to solve such problem, as shown in FIG. 3, the first side face 57 may further include a bypass hole defined therein for communicating the interior of the first filtration unit 5 to the collector body 371 and a third filter 571 disposed in the bypass hole. As shown in FIG. 3, the bypass hole and the third filter 571 may be located at a position higher than an uppermost end of the second filter 551 and lower than an uppermost end of the first filter 531. Accordingly, the laundry treating apparatus may minimize a phenomenon that the water sprayed to the first filtration unit 5 is not able to be re-collected into the collector body 371 due to the foreign matters remaining in the first filtration unit 5.

In one example, the laundry treating apparatus 100 may further include the washer 6 that washes the first filtration unit 5 using the water stored in the collector body 371. That is, the water stored in the collector body 371 may be separately collected into the water storage 7 or may be selectively flowed to the washer 6.

The washer 6 may be provided as means for washing at least one of the first filter 531, the second filter 551, the third filter 571, and the heat-absorber 41 by spraying the water stored in the collector body 371 to the first filtration unit 5. The washer 6 may be provided to include a sprayer 65 disposed in the duct 3 to supply the water to the first filtration unit 5, and a washing pump 61 that flows the water stored in the collector body 371 to the sprayer 65.

The washing pump 61 may be connected to the collector body 371 through a first connection pipe 611, and may be connected to the sprayer 65 through a second connection pipe 613. When the laundry treating apparatus is provided to flow the water of the collector body 371 to the sprayer 65 and the water storage 7 with only one washing pump 61, the laundry treating apparatus 100 may further include a flow passage switcher 63. In this case, the flow passage switcher 63 may be provided to be connected to the washing pump 61 through the second connection pipe 613, the sprayer 65 may be provided to be connected to the flow passage switcher 63 through a sprayer supply pipe 631, and the water storage 7 may be provided to be connected to the flow passage switcher 63 through a water storage supply pipe 633.

In this case, the water storage supply pipe 633 must be provided to connect a nozzle 722*a* and the flow passage switcher 63 with each other.

The flow passage switcher 63 has a valve for controlling opening and closing of the sprayer supply pipe 631 and opening and closing of the water storage supply pipe 633. Accordingly, the laundry treating apparatus 100 may supply the water stored in the collector body 371 to the sprayer 65 or to the water storage 7 by controlling the valve disposed on the flow passage switcher 63.

A case in which the sprayer 65 is provided to include a duct through-hole 651 defined therein to penetrate the connection duct 35 and connected to the sprayer supply pipe 631, a first guide 653 that guides the water supplied from the duct through-hole to the first filter 531, and a second guide 655 that guides at least a portion of the water supplied through the first guide 653 to the front face of the heat-absorber 41 is shown as an example. In this case, the second guide 655 may be provided as means for supplying the water to the front face of the heat-absorber 41 through the first filter 531. That is, the first filter 531 may be provided to be positioned between the first guide 653 and the second guide 655 when the first filtration unit 5 is fixed to the connection duct 35, and the second guide 655 may be provided as an inclined face inclined downward from a top face of the connection duct 35 toward the first filter 531.

A guide through-hole 654 may be further defined in the first guide 653. The guide through-hole 654 is a hole provided to penetrate the first guide 653. The water introduced into the duct through-hole 651 may be supplied to a front region of the heat-absorber 41 through the guide through-hole 654. The front region of the heat-absorber refers to a region located in a direction facing toward the first filter 531 based on a vertical line passing through a center of the heat-absorber 41.

In one example, the laundry treating apparatus of the present disclosure is preferably provided to include a water collector water level sensor 91 that measures a level of the water in the collector body 371 and transmits the water level information to the controller. When the water collector water level sensor 91 is disposed, the laundry treating apparatus may determine a time point for flowing the water stored in the collector body 371 to the storage body 72. Thus, the water in the collector body 371 may be prevented from flowing back to the connection duct 35.

The water collector water level sensor 91 may be configured as any device capable of sensing the level of the water inside the collector body 371. FIG. 3 shows a sensor with multiple electrodes having different lengths (with multiple electrodes electrically connected with each other based on the water level) as an example.

A dryness sensor may be disposed in the laundry treating apparatus 100 so as to determine a time point for stopping an operation of the heat-exchanger 4 by determining dryness of the laundry. The dryness sensor may be configured as at least one of an electrode sensor 95 configured to be in contact with the laundry to measure an amount of moisture contained in the laundry, and a humidity sensor that measures humidity of the air flowing from the drum 2 to the circulating flow passage 3.

The electrode sensor may be configured to include a first electrode 951 and a second electrode 953 which may be fixed to the first fixed body 171 and contact the laundry in the drum body 21. Because the dryness increases, the amount of moisture contained in the laundry will decrease (an electrical resistance of the laundry increases), the laundry treating apparatus 100 may determine the dryness of the laundry by observing the electrical resistance measured when the two electrodes 951 and 953 are connected to each other through the laundry. In one example, as the dryness of the laundry increases, the amount of moisture contained in the air flowing into the circulating flow passage 3 will decrease, so that the laundry treating apparatus 100 may determine the dryness of the laundry by observing the humidity of the air introduced into the circulating flow passage 3 through the humidity sensor.

In addition, the laundry treating apparatus 100 may further include a temperature sensor 96 that measures a temperature of the air flowed into the circulating flow passage 3. The temperature sensor 96 may be provided to be fixed to a top face of the connection duct 35 and be positioned between the first filter 531 and the second filter 551.

Figure 5A:
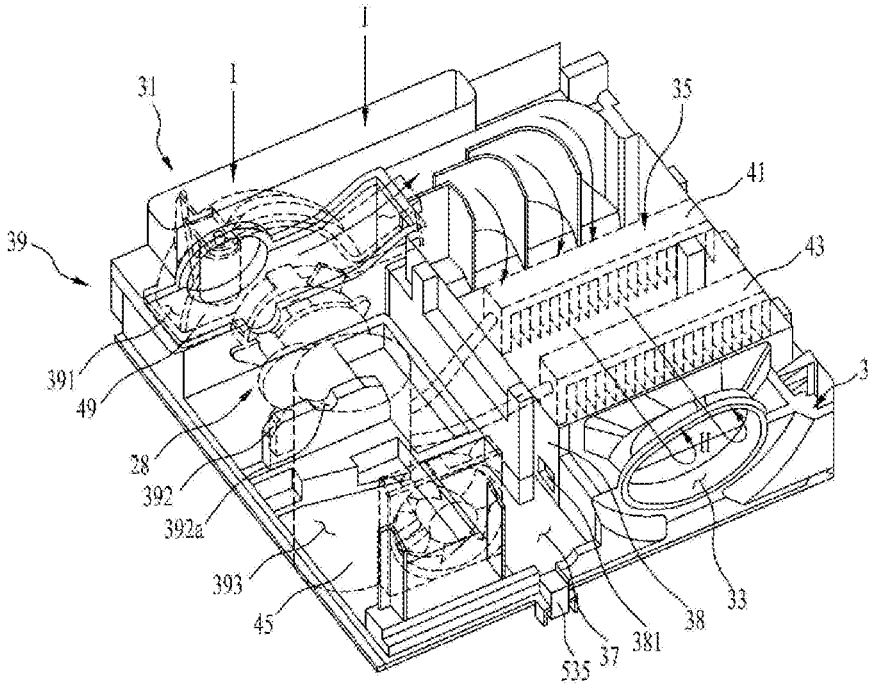
FIGS. 5A and 5B show a duct structure of a laundry treating apparatus of the present disclosure.
Figure 5B:
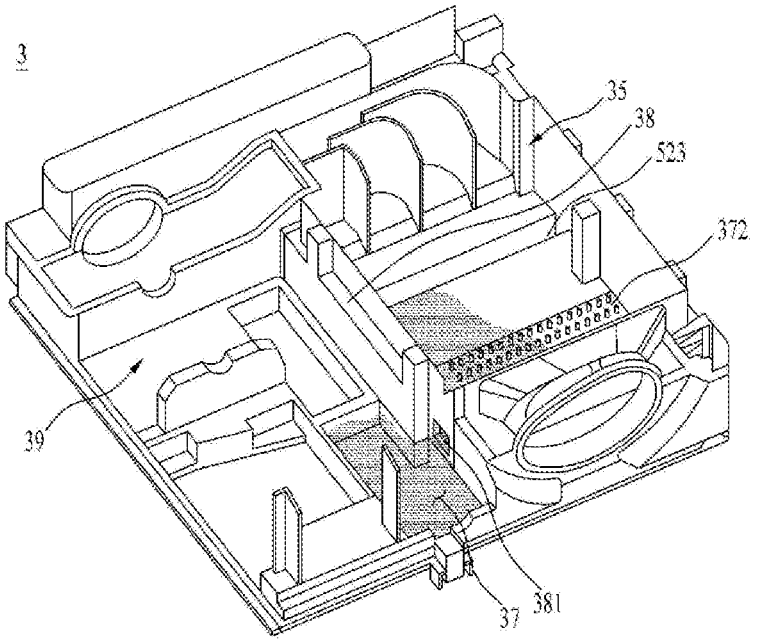

FIGS. 5A and 5B show an embodiment including the connection duct 35 and the water collector 37 arranged on the bottom face of the laundry treating apparatus of the present disclosure.

Referring to FIG. 5B, the laundry treating apparatus of the present disclosure may further include a base 39 that defines the circulating flow passage 3 and on which the heat-exchanger 4 may be installed.

A portion of the air discharge duct 31 may be installed on the base 39, and the air discharge duct 31 and the air supply duct 33 may be respectively installed at both ends of the connection duct 35.

The heat-absorber 41 and the heat-emitter 43 may be installed in the connection duct 35.

The base 39 may include an apparatus installation portion 392 in which an apparatus such as a compressor and the like may be installed on one side of the connection duct 35.

The apparatus installation portion 392 may include a compressor installation portion 393 in which the compressor 45 may be installed, a fan installation portion 391 in which a blower fan may be seated, and a driver installation portion 392*a* in which a driver may be installed In one example, the water collector 37 may be further disposed in the apparatus installation portion 392. The water collector 37 may not be disposed beneath the connection duct 35, but may be separated by a partition wall 38 and disposed at one side of the connection duct 35.

In one example, when the fan 39 is driven in an opposite direction and a flow direction of the air is changed, positions of the air discharge duct 31 and the air supply duct 33 may be interchanged and positions of the heat-emitter 41 and the heat-absorber 43 may be interchanged.

Referring to FIG. 5B, the connection duct 35 may include a heat-absorber mounting portion 372 in which the heat-absorber 41 may be installed, and a heat-emitter mounting portion 523 in which the heat-emitter may be mounted.

As the drying process proceeds, when the heat-exchanger 4 is driven, the air passing through the heat-absorber 41 is cooled and the moisture contained therein is condensed. When the moisture is condensed, water may accumulate in the vicinity of the heat-absorber mounting portion 372 as shown.

A vertical level of a bottom face of the connection duct 35 may decrease toward the water collector 37. The partition wall 38 may be provided to block the air flowing along the connection duct 35 from flowing to the apparatus installation portion 392, but may include a communication hole 381 defined therein to allow the condensed water to flow to the water collector 37.

The water condensed to the communication hole 381 may flow to the water collector 37 and be collected in the water collector 37. The washing pump 61 may be installed in the water collector 37. To this end, the water collector 37 may further include a pump fixing portion 535 in which the washing pump 61 is seated and fixed. The pump fixing portion 535 may be provided to space a bottom face of the washing pump 61 and the water collector 37 from each other by a predetermined distance.

Therefore, when sufficient water is collected in the water collector 37, the water may be removed by driving the washing pump 61. The flow passage switcher 63 may be controlled to spray the supplied water to the sprayer 65 or to flow the supplied water to the water storage 7.

Figure 6A:
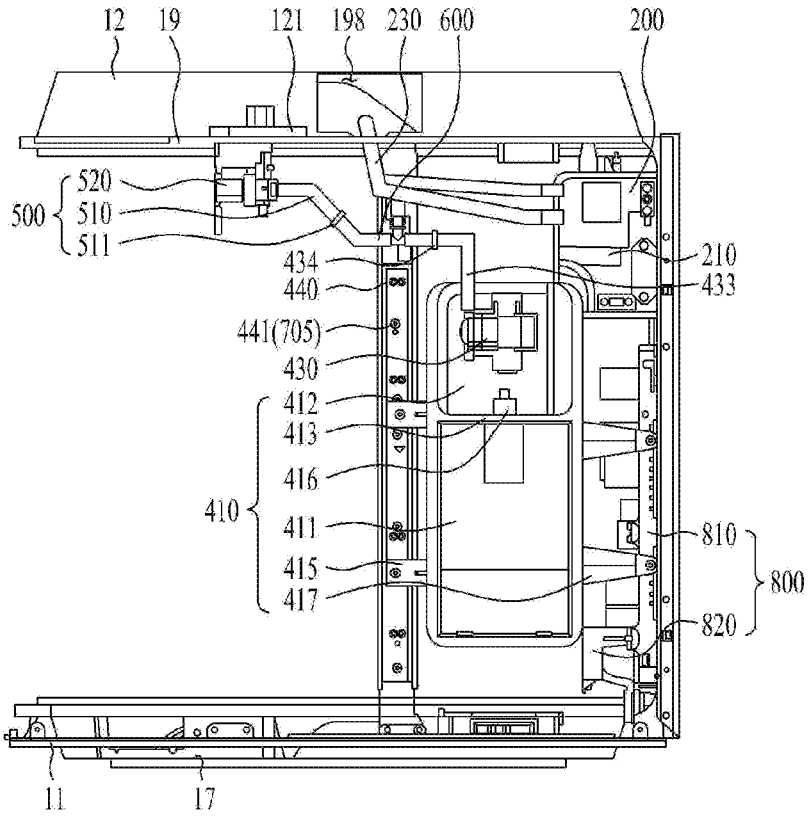
FIGS. 6A to 6C show a steam supply structure of a laundry treating apparatus of the present disclosure.
Figure 6B:
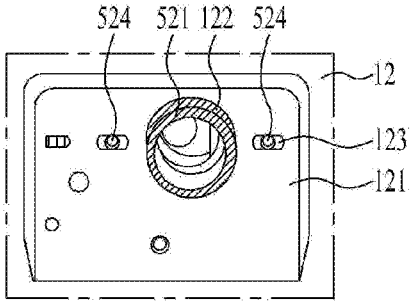
Figure 6C:
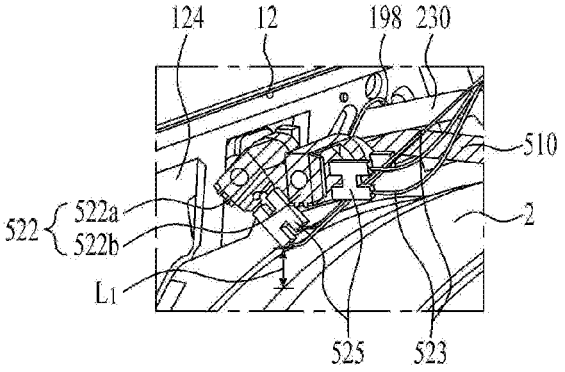

FIGS. 6A to 6C show an embodiment of the water supplier 300 of the laundry treating apparatus of the present disclosure.

Referring to FIG. 6A, the steam supplier 200 may be provided to be fixed to the side panel 14 for space utilization. That is, the steam supplier 200 may be disposed adjacent to an edge of the cabinet 1.

The internal water supplier 400 and the external water supplier 500 may be arranged adjacent to the steam supplier 200. Therefore, a flow passage structure of the steam supplier 200 and the water supplier 300 may be shortened as much as possible.

Typically, because the external water supplier 500 is disposed adjacent to the rear panel 13 or the second support 19, the steam supplier 200 may also be disposed adjacent to the rear panel 13.

The internal water supplier 400 may include the water tank 420 that stores the water therein, the water pump 430 that provides the power to supply the water stored in the water tank 420 to the steam supplier 200, and the tank housing 410 that defines therein the space in which the water pump 430 and the water tank 420 are installed.

The tank housing 410 may be formed in a box shape with an open top face, and may extend in a front and rear direction of the cabinet such that the water pump 430 is disposed in a front portion of the cabinet 1 and the water pump 430 is disposed in a rear portion of the cabinet.

The tank housing 410 may include a tank mounting portion 411 in which the water tank 420 is detachably mounted, and a pump mounting portion 412 in which the water pump 430 may be mounted. The tank mounting portion 411 and the pump mounting portion 412 are formed in a recess shape to prevent the water leaked from the water tank 420 or the water pump 430 from leaking to the drum 2 and the like.

In addition, the tank housing 410 may further include a partition wall 413 that partitions the tank mounting portion 411 and the pump mounting portion 412. Therefore, the water tank 420 may be easily mounted in and separated from the tank housing 410. The partition wall 413 may also serve to collect residual water in the tank mounting portion 411 or residual water in the pump mounting portion 412 so as not to flow to other places.

An extension pipe 416 for communicating the water tank 420 and the water pump 430 to each other may be installed on the partition wall 413. Because a valve structure may be installed on the extension pipe 416, even when the water tank 420 is separated from the tank mounting portion 411, the leakage of water may be prevented.

The extension pipe 416 may be provided to extend from the partition wall 413 toward the water pump 430 or the water tank 420.

In one example, the tank housing 410 may be formed such that the pump mounting portion 412 is disposed closer to the steam supplier 200 than the tank mounting portion 411. Therefore, a flow passage from the water tank 420 to the steam supplier 200 may be simplified.

The tank housing may be formed such that the tank mounting portion 411 and the pump mounting portion 412 are arranged along the front and rear direction of the cabinet. To this end, the tank housing may include a panel coupling portion 417 that is provided to extend from one side of the tank housing to be coupled to the side panel 14. The panel coupling portion 417 may include a plurality of panel coupling portions extending from an outer peripheral surface of the tank housing 410 to be seated on the side panel 14.

The panel coupling portion 417 is a separate fastening member, which may be fixed on the side panel 14.

In one example, even when the tank housing 410 is fixed with the panel coupling portion 417, the tank housing 410 needs to support not only the water tank 420 and the water pump 430 but also a load of the water collected in the water tank 420. Therefore, the laundry treating apparatus of the present disclosure may further include a support bar 440 to fix the tank housing 410 to the cabinet. The support bar 440 may be formed in a rod shape having both ends respectively coupled to the front panel 11 and the rear panel 12. Therefore, the support bar 440 may not only support the load of the tank housing 410, but also fix the front panel 11 and the rear panel 12. The support bar 440 may be spaced apart from the side panel 14 by a predetermined distance to be coupled to the front panel 11 and the rear panel 12.

The tank housing 410 may further include a support coupling portion 415 that extends from one face of the tank housing 410 toward the support bar 440 and coupled to the support bar 440. The support coupling portion 415 may include a plurality of support coupling portions that are arranged to be spaced apart from each other along a longitudinal direction of the tank housing 410 and are in a rib shape.

When the support coupling portion 415 extends from one face of the tank housing 410, the panel coupling portion 417 may be provided to extend from a face opposite to one face of the tank housing 410. That is, the support coupling portion 415 and the panel coupling portion 417 may have opposite extension directions.

The support coupling part 415 may be seated on the support bar 440 and coupled with a separate fastening member. Therefore, even when vibration is transmitted to the tank housing 410 such as when the water pump 430 is driven, the tank housing 410 may be fixed inside the cabinet 100.

The support bar 440 may include a plurality of support holes 441 along a longitudinal direction such that the fastening member may be coupled to the support bar 440. A coupling member 705 may be selectively coupled to the support hole 441.

Because of the support bar 440, a width of the tank housing 410 may be prevented from being excessively extended, and the tank housing 410 may be installed adjacent to the steam supplier 200.

In one example, at least a portion of one end of the tank housing 410 may be seated on and supported by the steam supplier 200. To this end, the steam supplier 200 may further include a support groove capable of supporting one edge of the tank housing 410.

The internal water supplier 400 may include a pump discharge pipe 433 that discharges the water from the pump housing 430 to the steam supplier 200.

The external water supplier 500 may include a direct water valve 520 mounted on the second support 19 or the rear panel 12, and a direct water pipe 510 provided to supply the water from the direct water valve 520 to the steam supplier 200.

The direct water pipe 510 may extend from the rear panel 12 to the steam supplier 200, and the direct water valve 520 may be provided to open and close the direct water pipe 510.

In addition, the direct water valve 520 may be provided to be seated on the rear panel 12 or the second support 19 and exposed to the outside, and the direct water pipe 510 may be provided to extend from the direct water valve 520 toward the steam supplier 200. Therefore, the external water supplier 500 may supply the water to the steam supplier 200 in a direct water scheme from the external water supply source.

The steam supplier 200 may be provided to receive the water from the external water supplier 500 and the internal water supplier 400 independently. However, when the steam supplier 200 is provided to receive the water through respective pipes, a separate shape of the steam supplier 200 must be manufactured, and the flow passage and the control method may become complicated.

To this end, the laundry treating apparatus of the present disclosure may further include a combining portion 600 that couples the direct water pipe 510 and the pump discharge pipe 433 to be combined with each other. The combining portion 600 may be provided to collect both the water stored in the internal water supplier 400 and the water supplied from the external water supplier 500 in the direct water scheme.

In addition, the combining portion 600 may be provided to deliver the supplied water to the steam supplier 200. The combining portion 600 may be provided as a three-way valve, or may be provided in a shape of a combined pipe in which three pipes are combined.

When the combining portion 600 is formed in the pipe shape, each of the external water supplier 500 and the internal water supplier 400 may have a check valve to prevent backflow.

Specifically, a direct water check valve 511 provided to open the direct water pipe 510 in one direction may be installed on the direct water pipe 510, and a discharge check valve 434 provided to open the pump discharge pipe 433 in one direction may be installed on the pump discharge pipe 433.

Therefore, the water supplied to the direct water pipe 510 may be prevented from flowing back to the water pump 430, and the water supplied to the pump discharge pipe 433 may be prevented from flowing back to the direct water valve 510.

In one example, the combining portion 600 has a considerable self load when being provided as the valve or the combined pipe. In addition, when the water passes through the combining portion 600, a considerable weight may be applied to the combining portion 600.

Accordingly, the combining portion 600 may be provided to be seated on the support bar 440.

The combining portion 600 and the support bar 400 are coupled with each other with a separate fixing member, so that the combining portion 600 may be prevented from being separated from the support bar 400. Because the combining portion 600 is seated on the support bar 400, positions of the direct water pipe 510 and the pump discharge pipe 433 may also be stably fixed.

In one example, the steam supplier 200 may include a water guide pipe 220 provided to be connected to the combining portion 600 to receive the water from the water supplier 300, a steam generator 210 that generates the steam by receiving the water from the water guide pipe 220, and a steam guide pipe 230 that may guide the steam generated from the steam generator 210 to the drum 2 or the circulating flow passage 3.

The steam guide pipe 230 may be connected to the air inlet 198 by communicating with the second support. At least a portion of the steam guide pipe 230 is also supported by the support bar 400 to prevent the steam guide pipe 230 from contacting the rotating drum 2.

In one example, the steam controller 800 that controls the water supplier 300 and the steam supplier 200 may be installed on the side panel 14. The steam controller 800 may be configured separately from the control panel 117 and prevent overloading of the main controller.

In addition, because the steam controller 800 is separately configured, the steam supplier 200 and the water supplier 300 may be added to the laundry treating apparatus such as an existing dryer in a modular form. Therefore, the steam controller 800 may be designed to additionally supply the steam to the existing dryer.

The steam controller 800 may include an installation panel 810 fixed to the side panel 14, a control panel 820 that is seated on the installation panel 810 and controls at least one of the steam supplier 200 and the water supplier 300. The control panel 820 may be provided to control both the direct water valve 520 and the water pump 430, and may also be provided to control the steam generator 210.

In one example, the tank housing 410 may include a mounting sensor capable of sensing whether the water tank 420 is mounted. For example, the mounting sensor may be configured as a pressure sensor or the like.

In addition, a water level sensor capable of sensing a water level of the water tank 420 may be further configured. For example, the water level sensor may be configured as a weight sensor. The mounting sensor or the water level sensor may also be controlled by the control panel 820 and may be configured to transmit a signal to the control panel 820.

In one example, the control panel 820 may indirectly identify the water level of the water tank 420 by temporarily driving the water pump 430 to sense a load applied to the water pump 430.

Referring to FIG. 6B, the rear panel 12 or the second support 19 may include an installation portion 121 on which the direct water valve 520 is installed. The installation portion 121 may be formed in a shape of protruding concavely from one face of the rear panel 12 or the second support 19. Therefore, the installation portion 121 may secure durability for the direct water valve 520 to be coupled thereto.

The direct water valve 520 may include an exposed pipe 521 protruding or exposed to the outside of the rear panel 12 or the second support 19, and a coupling bead 524 for coupling the exposed pipe 521 to the installation portion 121.

The installation portion 121 may include a water supply hole 122 through which the exposed pipe 521 may pass, and further include a coupling hole 123 to which the coupling bead 524 may be forcibly fitted or coupled. Accordingly, a load of the direct water valve 520 may be supported on the installation portion 121.

Referring to FIG. 6C, the direct water valve 520 may include an opening and closing body 522 that selectively opens and closes the exposed pipe 521, a body control line 523 that connects the opening and closing body 522 and the steam controller 800 with each other, and a receiver 525 to which the body control line 523 is coupled to transmit a signal to the opening and closing body.

The opening and closing body 522 may include a plurality of opening and closing bodies.

For example, the opening and closing body 522 may include a first opening and closing body 522*a* for opening and closing the exposed pipe 521, and a second opening and closing body 522*b* for selectively opening and closing the first opening and closing body 522*a*.

In addition, when the exposed pipe 521 includes a plurality of exposed pipes, the first opening and closing body 522*a* and a third opening and closing body 522*b* may selectively open and close the exposed pipes, respectively. Therefore, hot and cold water may be delivered to the exposed pipes, respectively.

In one example, the second support 19 may further include an exposed hole 124 to repair or replace the direct water valve 520.

The direct water valve 520 is spaced apart from the drum 2, so that the direct water valve 520 is not interfered even when the drum 2 rotates.

Figure 7:
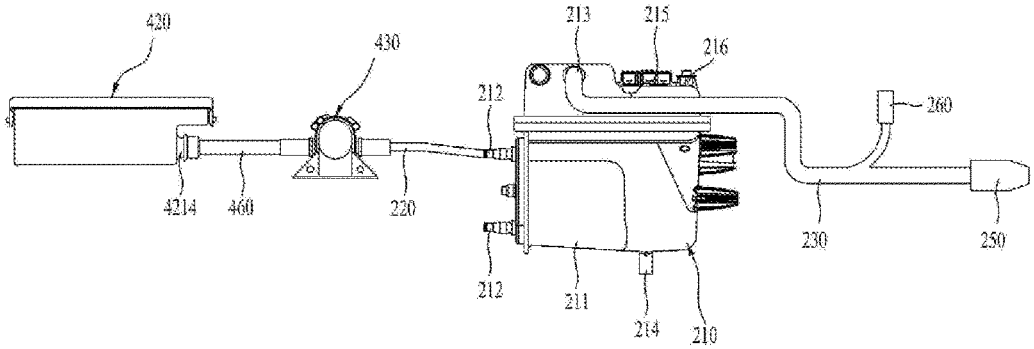
FIG. 7 shows a flow passage structure of a steam supply structure of a laundry treating apparatus of the present disclosure.

FIG. 7 shows a flow passage structure of internal water supplier 400 of the present disclosure.

The water tank 420 may be provided with a discharge portion 4214 for discharging the water. The discharge portion 4214 may be connected to the water pump 430 through the extension pipe 460, and the water pump 430 may supply the water to the steam supplier 200 through the water guide pipe 220.

The discharge portion 4214 may be provided to be detachable from the extension pipe 460.

The steam supplier 200 may include a steam housing 211 that generates the steam by receiving the water, a water inlet pipe 212 extending from the steam housing 211 to receive the water from the steam housing 211, a steam discharge pipe 213 provided to extend to discharge the steam generated in the steam housing 211 to the outside and be coupled with the steam guide pipe 230, a blocking valve 260 provided to adjust opening and closing of the steam guide pipe 230, and a spray nozzle 250 disposed at a distal end of the steam guide pipe 230 to spray the steam.

A water level sensor 215 and a temperature sensor 216 may be further arranged in the steam housing 211. The steam controller 800 may receive signals from the water level sensor 215 and the temperature sensor 216 and control the water pump 430 or the blocking valve 260.

The water accommodated in the water tank 420 may pass through the water pump 430 and be supplied to the steam housing 211. The water may be changed to the steam in the steam housing 211 in various ways, and may be selectively sprayed to the spray nozzle 250 by the opening and closing of the blocking valve 260.

In one example, the steam housing 211 may further include a pass pipe 214 capable of discharging the residual water in the steam housing 211 or discharging the water or the steam on trial.

The pass pipe 214 may be provided to partially discharge the water or the steam inside the steam housing to discharge the water remaining in the steam housing 211 or inspect whether the steam housing operates smoothly, and may exist separately from the water inlet pipe 212 and the steam discharge pipe 213.

The pass pipe 214 may extend from a bottom of the steam housing 211 such that the water or the steam may be discharged by a self load thereof. However, the pass pipe 214 may be provided as any component and disposed at any position as long as the water or the steam is able to be discharged.

Figure 8:
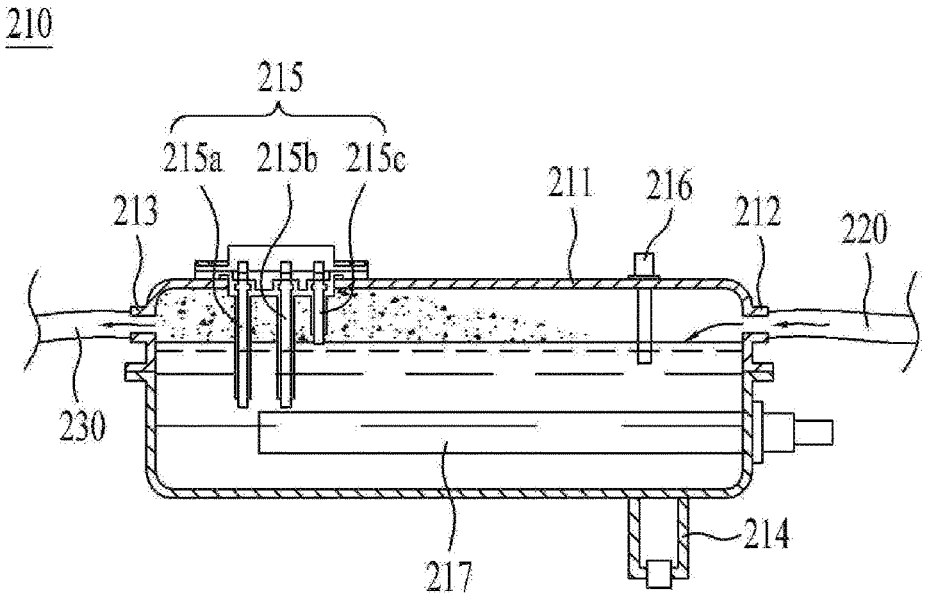
FIG. 8 shows a detailed structure of a steam supplier of a laundry treating apparatus of the present disclosure.

FIG. 8 shows a structure of the steam supplier. The steam supplier 200 includes the steam generator 210 in which the water is accommodated, a heater 217 mounted inside the steam generator 210, a water level sensor 260 that measures a water level of the steam generator 210, and a temperature sensor 270 that measures a temperature of the steam generator 210.

The water level sensor 260 is usually composed of a common electrode 262, a low water level electrode 264, and a high water level electrode 266 to sense high and low water levels by whether the common electrode 262 and the high water level electrode 264 are electrically connected to each other or whether the common electrode 262 and the low water level electrode 266 are electrically connected to each other.

The water guide pipe 220 for supplying the water may be connected to one side of the steam generator 210, the steam guide pipe 230 for discharging the steam may be connected to the other side of the steam generator 210, and the nozzle 250 in a predetermined shape may be disposed at the distal end of the steam guide pipe 230.

One end of the water guide pipe 220 may be connected to the combining portion 600, and the nozzle 250 of the steam guide pipe 230 may be connected to the drum 2 or the circulating flow passage 3.

A barrel heating scheme in which a certain amount of water accommodated in the steam generator 210 of a predetermined size is heated with the heater 217 to generate the steam may be applied to the steam supplier 200 of the laundry treating apparatus of the present disclosure.

However, the steam supplier 200 of the laundry treating apparatus of the present disclosure may use any apparatus capable of generating the steam as the steam generator. For example, a scheme of installing a heater directly around a water supply hose along which the water passes, that is, heating the water without accommodating the water in a predetermined space (hereinafter referred to as a "pipe heating scheme" for convenience) may be used, and an ultrasonic humidification scheme may also be applied.

The pass pipe 214 may be provided to be usually shielded by a separate opening and closing member. Therefore, the water or the steam may be prevented from being discharged arbitrarily.

Figure 9:
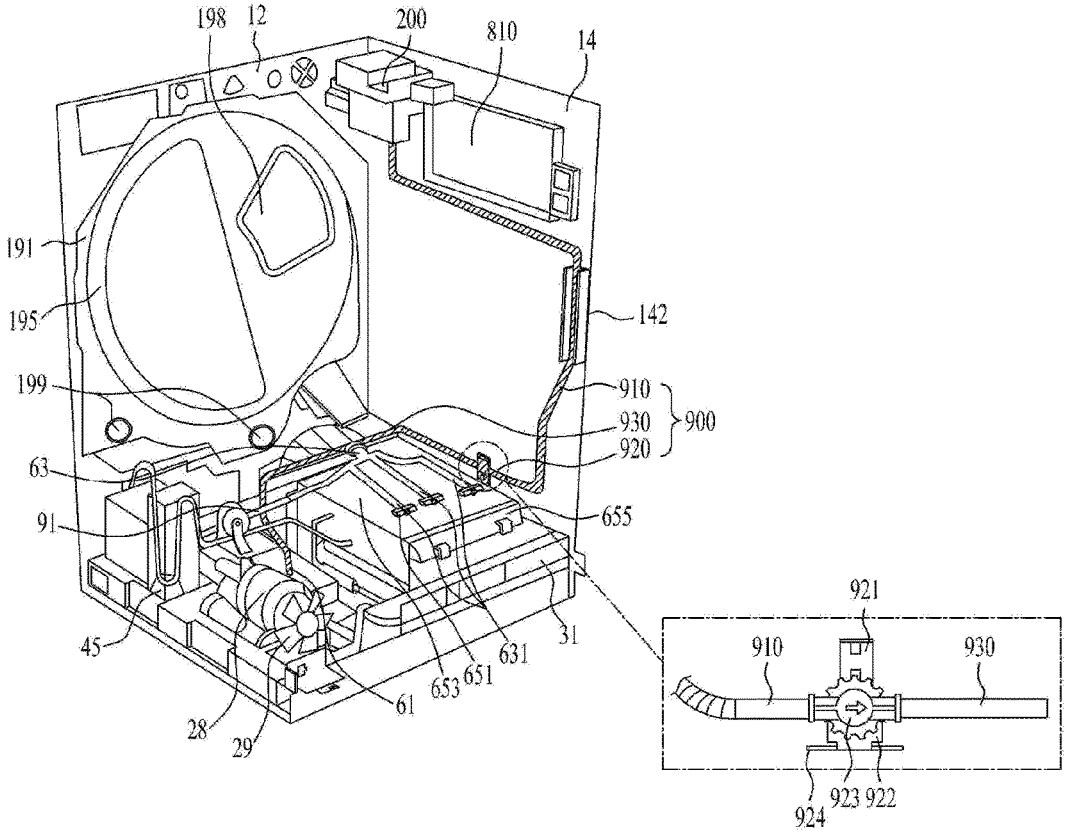
FIG. 9 shows an embodiment of arrangement of a sterilizer of a laundry treating apparatus of the present disclosure.

FIG. 9 shows an embodiment in which the laundry treating apparatus of the present disclosure sterilizes the exterior of the drum.

Referring to FIG. 9, in the laundry treating apparatus of the present disclosure, the steam supplier 200 may be coupled to the side panel 14, and the steam supplier 200 may be coupled to the installation panel 810 and fixed to the side panel 14. The steam supplier 200 may be installed adjacent to the edge or a vertex of the cabinet, thereby maximizing space utilization.

The second support 19 may be installed to be coupled to the rear panel 12. Even when the second support 19 is spaced apart from the rear panel 12, the second support 19 may be supported by the rear panel 12 and fixed.

The second fixed body 191 of the second support may be disposed in parallel with a rear face of the drum to not only support the drum and but also shield the rear face of the drum.

The second support body 195 is disposed on the second fixed body 191 in a shape corresponding to an outer circumferential surface of the drum 2 to not only seat the drum 2 inside the cabinet but also seal the drum 2.

A groove or the like that is recessed inward or outward may be installed in the second support body 195 in consideration of a flow or a noise of hot air. The air inlet 198 may be provided to pass through the second fixed body 191 to be in communication with the rear face of the drum 2, and may be provided to be in communication with a distal end of the air supply duct 33.

The steam supply pipe 230 of the steam supplier 200 may be provided to be in communication with the air supply duct 33 or the air inlet 198, thereby delivering the steam into the drum 2. The roller 199 may include a plurality of rollers supporting the outer circumferential surface of the drum 2 to be rotatable, and spaced apart from each other.

A distal end of the air discharge duct 31 may be connected to a front portion of the base 39, the heat-exchanger 4 may be seated in the connection duct 35 connected to the air discharge duct 31, and the washer 6 provided to shield the heat-exchanger 4 from the outside may be disposed. The washer 6 may form a top face of the connection duct 35 to partially define the flow passage along which the air introduced into the connection duct 35 passes.

The first guide 653 seated on the connection duct 35 may be disposed, and the second guide 655 may be disposed in front of the first guide 653. The duct through-hole 651 that passes through the first guide 653 to be in communication with the heat-exchanger may be defined on a top face of the first guide 653.

The sprayer supply pipe 631 may be fixed to the duct through-hole 651. The duct through-hole 651 may be defined at a position corresponding to the heat-absorber 41, and may include a plurality of duct through-holes arranged to be spaced apart from each other along a longitudinal direction of the heat-absorber 41.

The sprayer supply pipe 631 may also be branched into a plurality of sprayer supply pipes from the flow passage switcher 63 and the plurality of sprayer supply pipes may be respectively coupled to the plurality of duct through-holes 651. The sprayer supply pipes 631 are controlled to be opened by the flow passage switcher 63 sequentially in an outward or inward direction to wash the heat-absorber 41.

In one example, the base 39 may be disposed on the side of the connection duct 33 to define a space in which apparatuses are installed. A compressor 45 that supplies a refrigerant to the heat-exchanger 4 and a driver 28 that provides power for directly rotating the drum may be installed on the side of the connection duct 33. A cooling fan 29 that cools the compressor 45 or the driver 28 by injecting or discharging air may be installed in the driver 28.

The water collector may be installed on the bottom face of the base 39, so that the condensate generated in the heat-exchanger 4 may be collected. The water collector may flow the water to the flow passage switcher 63 or the water storage 7 by the washing pump 61. The washing pump 61 may be coupled to a top of the water collector to seal the water collector.

The water collector water level sensor 91 may sense a water level inside the water collector or a water level of the washing pump 61 to provide information for determining whether the condensate of a water level equal to or higher than a set water level is collected.

The laundry treating apparatus of the present disclosure may further include a sterilizer 900 provided to supply the water or the steam to the outside of the drum. The sterilizer 900 may be provided to supply the high-temperature water or the steam to the outside of the drum 2. That is, the sterilizer 900 may not be provided to sterilize the interior of the drum, but may be provided to sterilize at least a portion of the space between the outer circumferential surface of the drum 2 and an inner peripheral surface of the cabinet 1.

The sterilizer 900 may be provided to supply the high-temperature steam or the high-temperature water (the hot water) to at least a portion of the space defined between the outer face of the drum and the inner face of the cabinet. The high temperature may correspond to a temperature required to eradicate bacteria. The high temperature may be a temperature corresponding to a sterilization temperature. The bacteria are known to be usually eradicated when existing in an environment of a temperature equal to or higher than 50 degrees for 10 minutes or longer. Therefore, the sterilization temperature may be set to be equal to or higher than 50 degrees Celsius or 60 degrees Celsius.

The sterilizer 900 may be provided to receive the water from the water supplier 300. In this connection, because the supplied water must be heated to the sterilization temperature, it is preferable that the sterilizer 900 receives the water from the steam supplier 200.

The sterilizer 900 may include a high-temperature pipe 910 that is in communication with the steam supplier 200 to directly receive the water heated by the steam supplier 200. The high-temperature pipe 910 may extend from the steam supplier 200, and have one end coupled to the pass pipe 214.

The pass pipe 214 may extend from the bottom of the steam generator 210. Therefore, even when the steam is not supplied to the pass pipe 214, the high-temperature water may be supplied to the pass pipe 214. Accordingly, the sterilizer 900 may perform the sterilization using not only the steam but also the high-temperature water.

The sterilizer 900 may further include a sterilization valve 920 that adjusts opening and closing of the high-temperature pipe. The sterilization valve 920 may be controlled to determine whether to supply the water or the steam to the high-temperature pipe 910.

The sterilization valve 920 may be disposed on the steam supplier 200 itself. However, the sterilization valve 920 may be separately disposed outside the steam supplier 200 such that a structure of the conventional steam supplier 200 may be used as it is.

The sterilization valve 920 may be disposed anywhere as long as the sterilization valve 920 may be disposed outside the drum 2. As shown, the sterilization valve 920 may be mounted to be seated on the washer 6.

Because the sterilization valve 920 must support a load of the supply pipe 910 and a load of the water or the steam flowing through the supply pipe 910, it is preferable that the sterilization valve 920 is firmly fixed to an inner face of the washer 6 or the cabinet 1.

The cabinet 1 may include a gripping portion 142 capable of fixing a portion of the supply pipe 910 or being gripped. The gripping portion 142 may protrude from or be recessed into the side panel 14 to accommodate a portion of the supply pipe 910.

Therefore, even when the supply pipe 910 is extended to be relatively long, the supply pipe 910 may be stably maintained to be coupled to the pass pipe 214.

The sterilization valve 920 may include a coupling zone 924 fixed or coupled to the washer 6 or the cabinet 1, and an opening and closing portion 923 supported by the coupling zone 924 to open and close the supply pipe 910.

The sterilizer 900 may further include a sensor unit that senses a state of an interior of the high-temperature pipe, the sterilization valve, or the sterilization pipe. The sensor unit may include at least one of a temperature sensor 921 capable of sensing a temperature of the water passing through the supply pipe 910, and a pressure sensor 922 capable of sensing a pressure inside the supply pipe 910.

The temperature sensor 921 and the pressure sensor 922 may be connected to and controlled by the steam controller 800, and the steam controller 800 may be provided to control the opening and closing portion 923. Because the sterilization valve 920 is able to be controlled by the steam controller 800, the temperature sensor 921 or the pressure sensor 922 may be installed on the sterilization valve 920.

The sterilization valve 920 may be provided to open the supply pipe 910 when the temperature of the water or the steam delivered to the supply pipe 910 is the sterilization temperature. The sterilization valve 920 may be controlled to close the supply pipe 910 when the temperature of the water or the steam supplied to the supply pipe 910 is equal to or lower than the sterilization temperature, and may wait until the water supplied from the steam supplier 200 to the supply pipe 910 is heated to have the temperature equal to or higher than the sterilization temperature.

The sterilization valve 920 may be provided to be opened when the temperature of the water or the steam supplied to the supply pipe 910 is equal to or higher than the sterilization temperature.

In one example, the sterilization valve 920 may be controlled to close the supply pipe 910 when a pressure of the supplied water or steam is equal to or lower than a reference pressure. The water or the steam may be heated by the steam supplier 200 until a pressure of water or steam at the supply pipe 910 becomes the reference pressure.

The reference pressure may be a pressure when the temperature of the water is equal to or higher than the sterilization temperature. Alternatively, the reference pressure may be a pressure when the water is completely converted to the steam.

In one example, the sterilizer 900 may include a sterilization pipe 930 that supplies the water from the sterilization valve 920 to the outside of the drum. The sterilization pipe 930 may be provided to supply the high-temperature water or steam to a region requiring the sterilization. For example, the sterilizer 900 may extend from the sterilization valve 920 to the washing pump 61 to deliver the high-temperature water or steam to the washing pump 61.

The high-temperature water or steam may be supplied to the washing pump 61 to sterilize the interior of the water collector. In addition, the washing pump 61 may deliver the high-temperature water or steam to the flow passage switcher 63 to supply the high-temperature water or steam to the heat-exchanger 4. Therefore, the heat-exchanger 4 may also be sterilized.

In one example, the sterilizer 900 may open the sterilization valve 920 so as to supply the high-temperature water or steam during the sterilization time. To this end, the steam supplier 200 may receive sufficient water to supply the high-temperature water or steam from the water supplier 300 to the sterilization pipe 930 during the sterilization time. In addition, the sterilization valve 920 may adjust an opening degree of the water supply pipe 910 so as to continuously supply the water during the sterilization time based on the water level of the steam supplier 200.

As a result, the sterilizer 900 may be provided such that the water supplied from the steam supplier 200 is supplied to the region between the outer circumferential surface of the drum 2 and the inner face of the cabinet 1 to sterilize the interior of the region. The high-temperature water and steam supplied to the region between the outer circumferential surface of the drum 2 and the cabinet 1 may be collected again into the water collector 37 after the sterilization is completed, and then collected in the water storage 7 through the washing pump 61.

In one example, because the sterilizer 900 extends from the steam supplier 200, the supply pipe 910 is positioned above the drum 2. In addition, because the sterilizer 900 mainly performs the sterilization at the washing pump 61, the water collector 37, and the heat-exchanger 4, the sterilization pipe 930 extends downward than the drum 2. Therefore, it may be important to fix the supply pipe 910 and the sterilization pipe 930 so as not to interfere with the rotating drum 2.

The sterilizer 900 of the laundry treating apparatus of the present disclosure may be disposed to be spaced apart from the outer face of the drum 2 to prevent the contact of the interference between the sterilizer 900 and the drum.

The sterilizer 900 may be at least partially fixed to the cabinet or the circulating flow passage so as to be spaced apart from the drum.

At least a portion of the high-temperature pipe 190 may be fixed to the cabinet to extend from the steam supplier 200. In addition, the sterilization valve 920 may be coupled to the circulating flow passage 3 to be coupled to the inner face of the cabinet or may be as close as possible to the inner face of the cabinet 1.

The cabinet 1 may further include the gripping portion 142 that fixes the high-temperature pipe 910 to the cabinet 1 and separates the high-temperature pipe 910 from the drum.

For example, it is preferable that the sterilization valve 920 is fixed on the side panel 14 and a portion of the supply pipe 910 is coupled to or attached to the side panel 14. At least a portion of the sterilization pipe 930 may be disposed to be seated in the circulating flow passage 3. The sterilization pipe 930 may extend to a sterilization region while at least partially being coupled or attached to the component of the base 39 such as the heat-exchanger 4, the washer 6, or the like.

The supply pipe 910 may be attached to and extended along one face of the side panel 14. The side panel 14 may have the gripping portion 142 to fix the supply pipe 910, thereby blocking contact between the supply pipe 910 and the drum 2.

In one example, the sterilization valve 920 may be fixed to the circulating flow passage 3 or the washer 6 to prevent the sterilization pipe 930 from contacting the drum 2 in advance. In addition, the sterilization pipe 930 may extend along a surface of the circulating flow passage 3 or the washer 6.

Therefore, it is possible to prevent the sterilizer 900 from interfering with the rotating drum 2 in advance.

In one example, when the heater is additionally operated in the steam supplier 200 during the drying process, an overload may occur. Accordingly, the sterilizer 900 may be operated when the drying process is terminated. In addition, the sterilizer 900 may be driven when the heat-exchanger 4 is not operated even during the drying process, and may be driven when the operation of the heat-exchanger 4 is completed during the drying process.

In one example, the sterilizer 900 may be provided to supply only the water, not the steam, to the region requiring sterilization.

A plurality of components are installed between the inner face of the cabinet 1 and the outer face of the drum 2. The components may include a product made of metal, and may include an electronic product through which electricity may flow. Therefore, it may not be desirable to increase the humidity in the space between the inner face of the cabinet 1 and the outer face of the drum 2.

In addition, the water has greater thermal energy than the steam even at the same temperature, and has a superior contact force. Therefore, it may be more advantageous for the sterilization to contact the sterilization region with the high-temperature water than to spray the steam into the sterilization region.

Furthermore, the steam may have a smaller specific gravity than the air inside the cabinet 1. Therefore, even when the steam is sprayed into a desired space, the steam may be unintentionally lifted, so that an intended sterilization effect may not be achieved.

In addition, the steam generated by the steam supplier 200 may be unintentionally lifted upward of the steam generator 210. Furthermore, because the water must always be located below the steam supplier 200, it may be difficult to supply the steam to the sterilization valve 920 located below the steam supplier 200.

As a result, the steam supplier 200 may heat the high-temperature water only until the high-temperature water becomes the steam and supply the steam to the sterilizer 900, and the sterilizer 900 may be provided to supply only the high-temperature water.

In one example, the sterilizer 900 may be provided to spray the vapor obtained by heating and vaporizing the high-temperature water or the steam into the sterilization space as needed. In this case, the steam supplier 200 may heat the water to generate the vapor. In addition, when it is difficult for the steam supplier 200 to directly supply the steam to the sterilizer 900, the sterilization valve 920 may be provided as an expansion valve.

Accordingly, the sterilization valve 920 may be provided to expand the high-temperature water and change the high-temperature water into relatively low-temperature steam or vapor.

Figure 10:
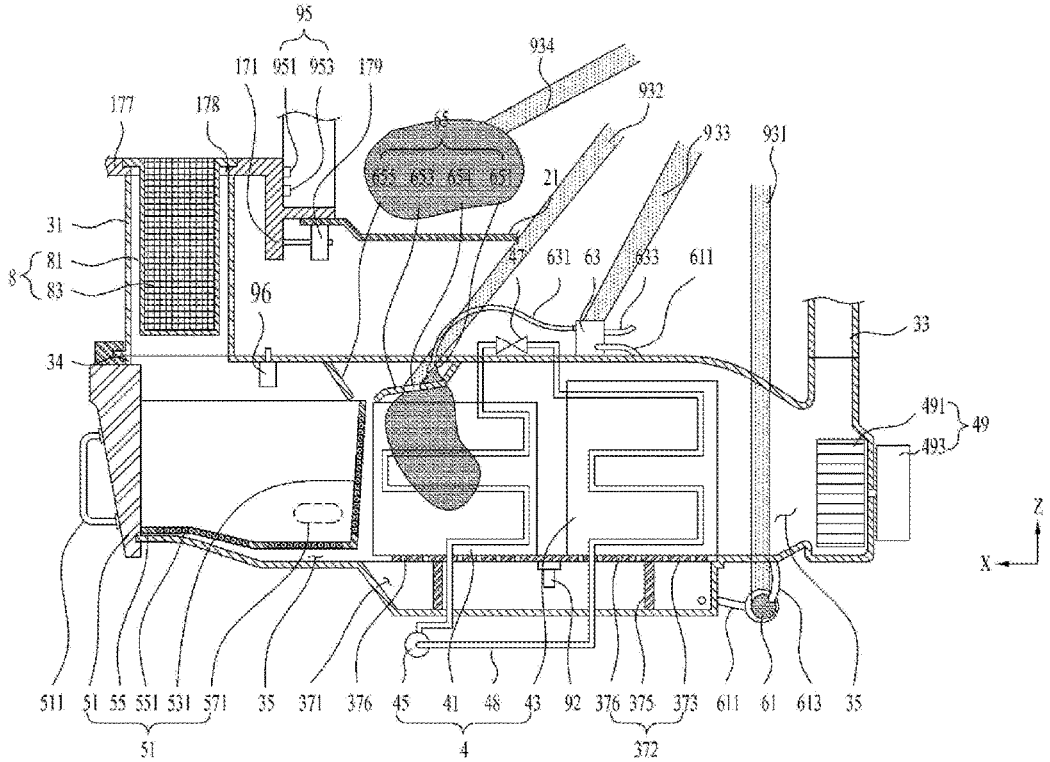
FIG. 10 shows a region that may be sterilized by a laundry treating apparatus of the present disclosure.

FIG. 10 shows a specific region that may be sterilized by the sterilizer 900.

The sterilizer 900 may be provided to supply the heated water or the steam to at least one of the water collector 37 and the water storage 7.

In addition, the sterilizer 900 may be provided to supply the heated water or the steam to the washer 6. The sterilizer 900 may be provided to supply the heated water or the steam to at least one of the washing pump 61, the flow passage switcher 63, and the sprayer 65.

The sterilization pipe 930 may be provided to extend from the sterilization valve 920 to one or more of the water collector 37, the flow passage switcher 63, and the sprayer 65 to supply the heated water or the steam.

The present disclosure sterilization pipe 930 of the sterilizer may include a pump sterilization pipe 931 provided to directly supply the high-temperature water or the steam to the washing pump 61.

The pump sterilization pipe 931 may be provided to extend from the sterilization valve 920 to the washing pump 61.

The pump sterilization pipe 931 may receive the high-temperature water or the steam through the sterilization valve 920 and directly supply the high-temperature water or the steam to the washing pump 61. Therefore, the washing pump 61, which is usually exposed to the condensate, may be primarily sterilized and washed immediately.

The high-temperature water or the steam supplied to the washing pump 61 is delivered to the water collector 37 as it is. Therefore, the water collector 37 may also be sterilized and washed secondary.

In one example, when the high-temperature water is supplied to the washing pump 61, the sterilization valve 920 may be controlled to be opened. In addition, when the water in the water collector 37 is supplied from the washing pump 61 to the flow passage switcher 63, the sterilization valve 920 may be controlled to be closed.

The sterilizer 900 may indirectly sterilize the flow passage switcher 63, the sprayer 65, and the heat-exchanger 4 by supplying the high-temperature water or the steam to the washing pump 61. In addition, the water storage 7 may also be sterilized by supplying the high-temperature water or the steam to the water storage 7 under the control of the flow passage switcher 63.

Accordingly, the sterilizer 900 may sterilize an entirety of the flow passage through which the condensate is supplied.

However, the sterilizer 900 may be provided to intensively sterilize a specific region with a small amount of water or steam.

For example, the sterilization pipe 930 may include a heat sterilization pipe 932 provided to supply the high-temperature water or the steam directly to the heat-exchanger 4.

The heat sterilization pipe 932 may be provided to extend from the sterilization valve 920 to the washer 6. Specifically, the heat sterilization pipe 932 may be provided to communicate with the washer 6 positioned at a corresponding portion of the heat-exchanger 4. For example, the heat sterilization pipe 932 may be provided to extend to the guide through-hole 654.

The heat sterilization pipe 932 may be provided to extend to a corresponding position of the heat-absorber 41. This is because the heat-absorber 41 is a component that firstly comes into contact with the air discharged from the drum 2, and a component that is easily exposed to moisture as the water is firstly condensed in the air.

Therefore, the heat-absorber 41 may be immediately sterilized with the high-temperature water or the steam supplied from the heat sterilization pipe 932. In addition, when sufficient high-temperature water or steam is supplied from the heat sterilization pipe 932, the high-temperature fluid may sterilize the connection duct 35 and the washing pump 61 together.

In one example, the heat sterilization pipe 932 may be provided to supply the high-temperature water or the steam to one of the components of the sprayer 65 as well as the guide through-hole. Because the sprayer 65 receives the condensate through the flow passage switcher 63, the sprayer 65 is always easy to be exposed to the moisture. Accordingly, the heat sterilization pipe 932 may be in communication with the sprayer 65 itself so as to sterilize the sprayer 65 first to supply the high-temperature water or the steam.

As a result, the heat sterilization pipe 932 may directly supply the high-temperature water or the steam to the heat-exchanger 4 to not only wash, but also sterilize the heat-exchanger 4, and may secondarily sterilize the washer 6.

The sterilization pipe 930 may include a switch sterilization pipe 933 provided to supply the high-temperature water or the steam to the flow passage switcher 63. The high-temperature water or the steam may be supplied to perform the sterilization starting from the flow passage switcher 63. In addition, the high-temperature water or the steam may be supplied to the water storage 7 under the control of the flow passage switcher 63 to sterilize the water storage 7, and may be supplied to the sprayer 65 to sterilize at least one of the sprayer 65, the heat-exchanger 4, and the washing pump 61.

The sterilization pipe 930 may include one or more or all of the pump sterilization pipe 931, the heat sterilization pipe 932, and the switch sterilization pipe 933. When the sterilization pipe 930 includes two or more of the pump sterilization pipe 931, the heat sterilization pipe 932, and the switch sterilization pipe 933, the sterilization valve 920 may be provided to open only one of the pump sterilization pipe 931, the heat sterilization pipe 932, and the switch sterilization pipe 933. For example, the sterilization valve 920 may be formed as a three-way, a four-way valve, or the like.

In one example, the high-temperature water rather than the high-temperature steam may be supplied to the pump sterilization pipe 931, the heat sterilization pipe 932, and the switch sterilization pipe 933. Because the water supplied to the pump sterilization pipe 931, the heat sterilization pipe 932, and the switch sterilization pipe 933 may be cooled while passing through many regions, the high-temperature water may be more beneficial for the sterilization than the steam.

In particular, when the condensate is collected in the water collector 37, because the steam may be cooled or condensed as soon as the steam contacts the condensate, it is preferable that the high-temperature water is supplied to the sterilization pipe 930.

To this end, the steam supplier 200 may heat the water supplied from the water supplier 300 such that water of a temperature equal to or higher than 50 degrees and lower than 100 degrees is supplied to the sterilization pipe 930.

In one example, the sterilization pipe 930 may further include an internal sterilization pipe 934 provided to sterilize the space between the outer face of the drum 2 and the inner face of the cabinet 1. The internal sterilization pipe 932 may be exposed to the outside of the drum 2 and extend from the sterilization valve 920. As long as the internal sterilization pipe 932 does not come into contact with the rotating drum 2, the internal sterilization pipe 932 may extend anywhere into the cabinet 1.

The internal sterilization pipe 932 may supply the high-temperature water or the steam to the interior of the cabinet 1 to sterilize an entirety of the interior of the cabinet 1. In this connection, because there are the plurality of electronic products such as the compressor, the driver, and the like inside the cabinet 1, it is preferable that the high-temperature steam is supplied to the internal sterilization pipe 932.

The steam supplied to the internal sterilization pipe 932 may be used to remove the bacteria or fungi that may propagate or be generated inside the cabinet 1.

Figure 11:
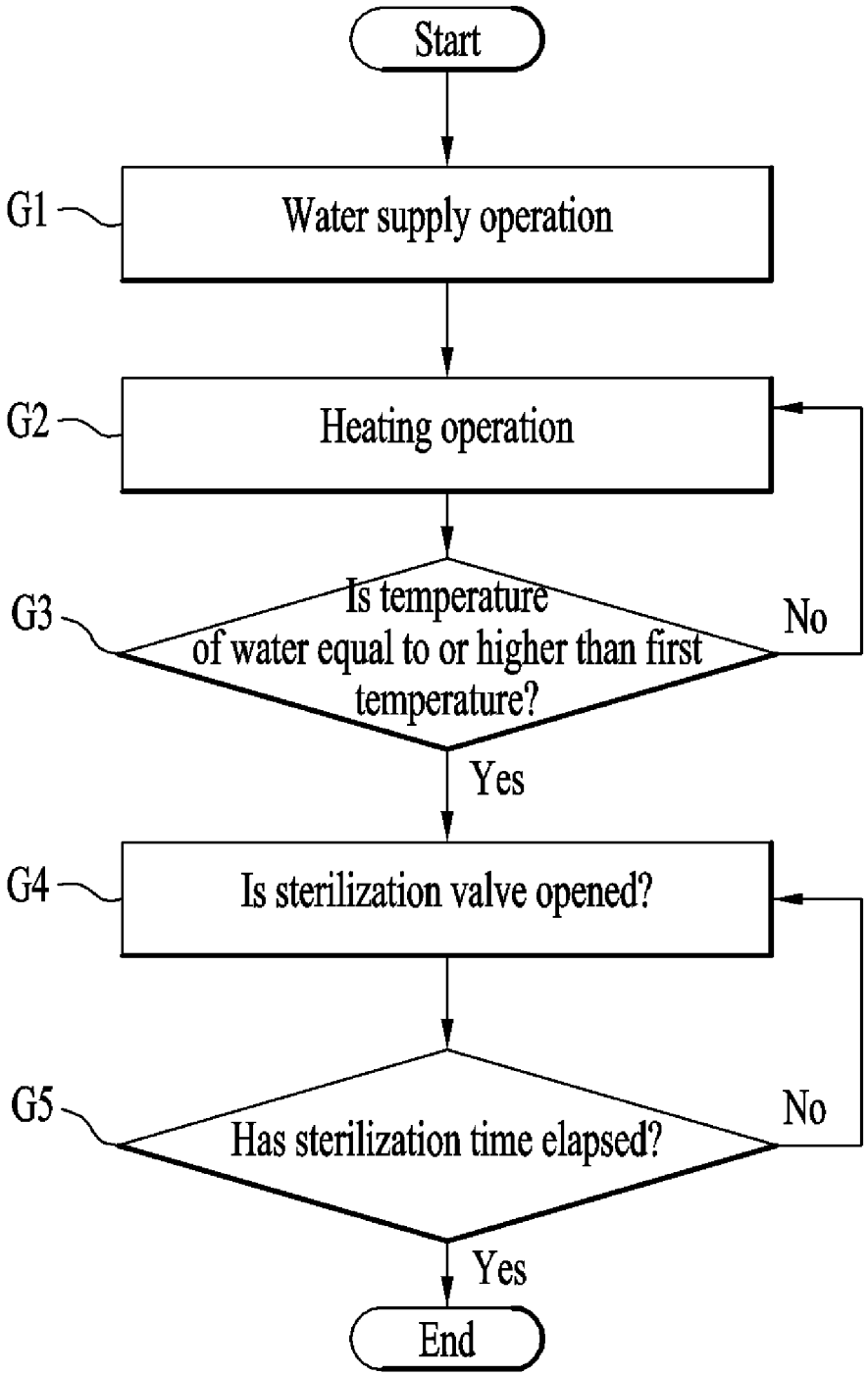
FIG. 11 shows an embodiment of a method for controlling a sterilizer.

FIG. 11 shows an embodiment of a method for controlling the sterilizer 900.

When a sterilization mode for heating the sterilizer 900 is performed, a heating operation G2 of heating the water in the steam supplier 200 may be performed. In order to perform the heating operation G2, a water supply operation G1 of supplying the water from the water supplier 300 to the steam supplier 200 may be preceded.

When the water is able to be supplied from the external water supplier 500, the water supply operation G1 may be controlled to supply the water from the external water supplier 500 to the steam supplier 200. This is because the water supplied from the external water supplier 500 is relatively fresher than the water from the internal water supplier 400 and is suitable for the sterilization.

In one example, because the water contained in the internal water supplier 400 is also heated in the steam supplier 200, a sterilization effect may be guaranteed. Accordingly, the water in the internal water supplier 400 may be supplied to the steam supplier 200.

In one example, the water supply operation G1 may supply the water of an amount greater than an amount required for generating, by the steam supplier 200, the steam to the steam supplier 200. For example, the water may be supplied to fill the steam supplier 200 to a maximum water level.

This is because the amount of the water required for the sterilization may be greater than an amount of the steam required for the drying process, and the high-temperature water, not the steam, is required to be supplied to the sterilizer 900.

When a sufficient amount of water required for the sterilization is supplied from the steam supplier 200 and heated in the sterilizer 900, a first sensing operation G3 of sensing whether the temperature of the water is equal to or higher than the sterilization temperature (a first temperature) may be performed. The first sensing operation G3 may be an operation of sensing whether the temperature inside the steam supplier 200 is equal to or higher than the sterilization temperature, or sensing whether a temperature inside the sterilization valve 920 or the temperature of the water delivered into the supply pipe 910 or the sterilization valve 920 is equal to or higher than the sterilization temperature.

When the temperature is equal to or higher than the sterilization temperature, an opening operation G4 in which the sterilization valve 920 opens the supply pipe 910 may be performed. The sterilizer 900 may be controlled to supply the water or the steam only when the temperature of the heated water is equal to or higher than the sterilization temperature.

The sterilization valve 920 or the steam supplier 200 may be controlled by the steam controller 800.

A termination determination operation G5 of sensing whether a time ensuring the sterilization has elapsed after the sterilization valve 920 is opened or whether the sterilization mode is terminated may be performed.

When a sterilization time (e.g., 10 minutes) for securing the sterilization elapses or the sterilization mode is terminated in the termination determination operation G5, a termination operation of closing the sterilization valve 920 and terminating the driving of the steam supplier 200 may be performed.

Therefore, the high-temperature water or the steam may be discharged to the sterilization pipe 930 to sterilize at least a portion of the region outside the drum. Therefore, not only the propagation of the bacteria or the fungi inside the cabinet 1 may be prevented, but also a possibility of an occurrence of odor and contamination of the laundry may be prevented.

Figure 12:
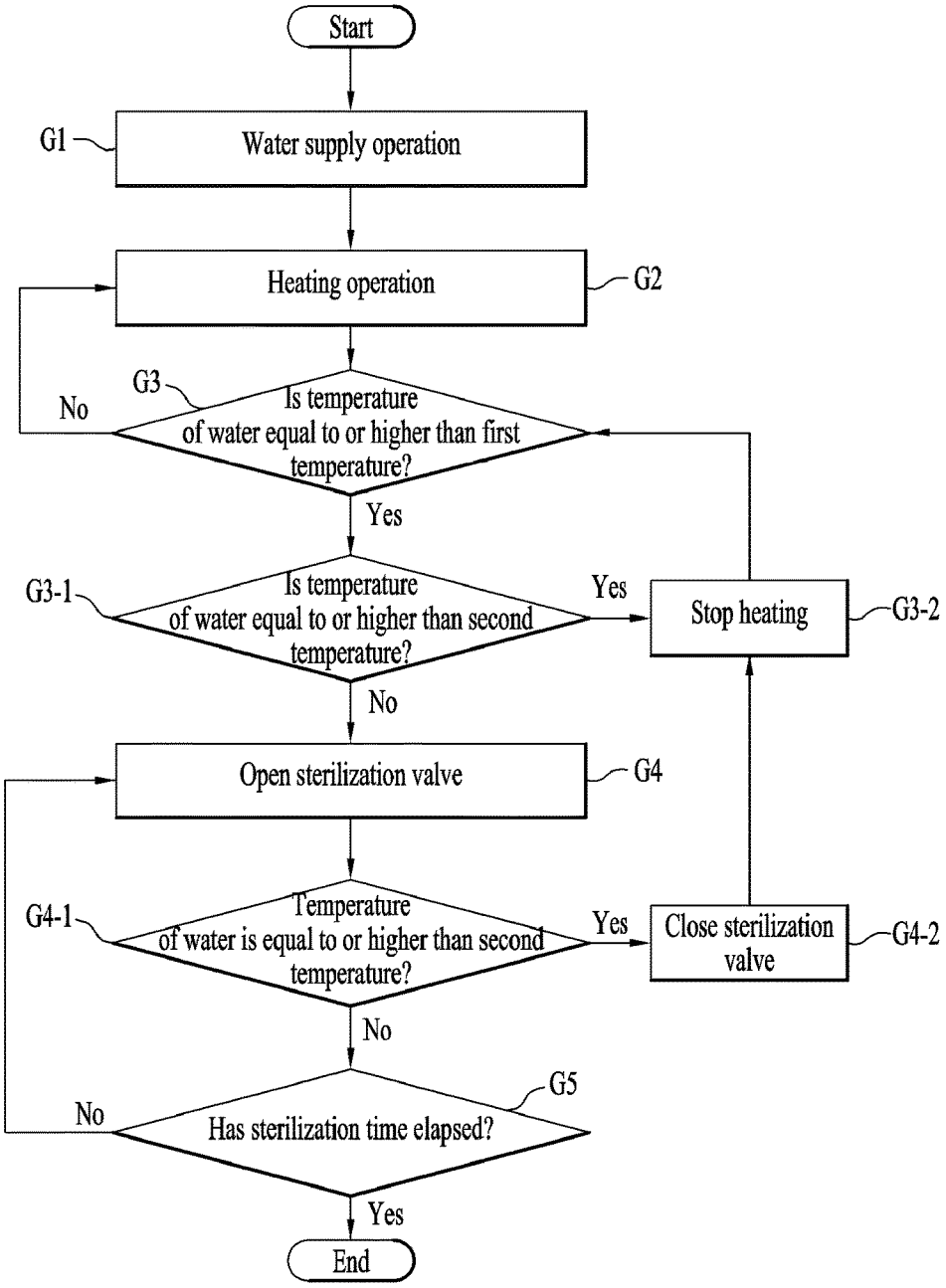
FIG. 12 shows another embodiment of a method for controlling a sterilizer.

FIG. 12 shows another method for controlling the sterilizer 900.

The sterilizer 900 supplies the high-temperature water or the steam at the sterilization temperature (or the first temperature). However, as described above, when sterilizing one of the water collector 37, the washing pump 61, the heat-exchanger 4, and the water storage 7, the high-temperature water may be more suitable than the steam.

Accordingly, the sterilizer 900 may be controlled such that the water with the temperature higher than the sterilization temperature but lower than a vaporization temperature (or a second temperature) may be supplied to the sterilizer 930.

When the sterilization mode of heating the sterilizer 900 is performed, a heating operation G2 of heating the water in the steam supplier 200 may be performed. In order to perform the heating operation G2, the water supply operation G1 of supplying the water from the water supplier 300 to the steam supplier 200 may be preceded.

When the water is able to be supplied from the external water supplier 500, the water supply operation G1 may be controlled to supply water from an external water supplier 500 to the steam supplier 200. This is because the water supplied from the external water supplier 500 is relatively fresher than the water from the internal water supplier 400 and is suitable for the sterilization.

In one example, because the water contained in the internal water supplier 400 is also heated in the steam supplier 200, a sterilization effect may be guaranteed. Accordingly, the water in the internal water supplier 400 may be supplied to the steam supplier 200.

In one example, the water supply operation G1 may supply the water of an amount greater than an amount required for generating, by the steam supplier 200, the steam to the steam supplier 200. For example, the water may be supplied to fill the steam supplier 200 to a maximum water level.

This is because the amount of the water required for the sterilization may be greater than an amount of the steam required for the drying process, and the high-temperature water, not the steam, is required to be supplied to the sterilizer 900.

When a sufficient amount of water required for the sterilization is supplied from the steam supplier 200 and heated in the sterilizer 900, the first sensing operation G3 of sensing whether the temperature of the water is equal to or higher than the sterilization temperature (the first temperature) may be performed.

When the temperature of the water is equal to or higher than the sterilization temperature, a second sensing operation G3-1 of sensing whether the temperature of the water is equal to or higher than the vaporization temperature (the second temperature) may be performed. In the second sensing operation G3-1, when the temperature of the water is equal to or lower than the vaporization temperature, the opening operation G4 of opening the sterilization valve may be performed. That is, the opening operation G4 may be understood as an operation in which the sterilization valve 920 is opened when the water heated by the steam supplier 200 or supplied to the supply pipe 910 is equal to or higher than the sterilization temperature and is equal to or lower than the vaporization temperature.

For example, the opening operation G4 may be controlled to open the sterilization valve 920 when the temperature of the water is equal to or higher than 55 degrees and lower than 100 degrees.

The sterilizer 900 may be controlled to supply the water or the steam when the temperature of the heated water is equal to or higher than the sterilization temperature and equal to or lower than the vaporization temperature at which the water is vaporized.

In one example, in the second sensing operation G3-1, when the temperature of the water is equal to or higher than the vaporization temperature, a heating stopping operation G3-2 of stopping driving of the steam supplier 200 may be performed. The heating stopping operation G3-2 may be performed until the temperature of the water decreases to be equal to or lower than the vaporization temperature.

For example, it may be understood that the first sensing operation G3 and the second sensing operation G3-1 are performed again.

When the temperature of the supplied water or the steam is sensed to be equal to or higher than the vaporization temperature, the sterilizer 900 may be controlled to stop supplying the water or the steam and the steam supplier 200 may be controlled to stop heating the water.

In one example, when the sterilization valve G4 is opened, the high-temperature water is supplied to the sterilization region through the sterilization pipe 930. Even at this time, the heating in the steam supplier 200 may be continued. Accordingly, while the sterilization valve G4 is opened, a third sensing operation G4-1 of sensing whether the temperature of the water flowing through the supply pipe 910 is equal to or higher than the vaporization temperature may be performed.

In one example, the termination determination operation G5 of sensing whether a time ensuring the sterilization has elapsed after the sterilization valve 920 is opened while the temperature of the water discharged to the sterilization pipe 930 or the water supplied to the supply pipe 910 is equal to or lower than the vaporization temperature during the third sensing operation G4-1 or whether the sterilization mode is terminated may be performed.

When the sterilization time (e.g., 10 minutes) for securing the sterilization elapses in the termination determination operation G5, the termination operation of closing the sterilization valve 920 and terminating the driving of the steam supplier 200 may be performed. The sterilizer 900 may be controlled to stop the supply of the water or the steam when the supply of the water or the steam continues for the sterilization time, and the steam supplier 200 may be controlled to stop the heating of the water when the sterilization time elapses.

In one example, when the temperature of the supply pipe 910 or the sterilization pipe 930 rises to be equal to or higher than the vaporization temperature before the termination determination operation G5, a locking operation G4-2 of closing the sterilization valve 920 may be performed. Therefore, unintentional supply of the steam or the vapor to the outside of the drum 2 may be blocked.

When the locking operation G4-2 is performed, the heating stopping operation G3-2 of stopping the driving of the steam supplier 200 may be performed.

When the temperature of the water or the steam is equal to or lower than the vaporization temperature, the sterilizer 900 may re-supply the water or the steam and the steam supplier 200 may re-heat the water.

Therefore, only the high-temperature water that may perform the sterilization may be supplied to the region located outside the drum 2. For example, the high-temperature water may be supplied to one of the washing pump 61, the water collector 37, the washer 6, and the heat-exchanger 4 to perform the sterilization.

Figure 13:
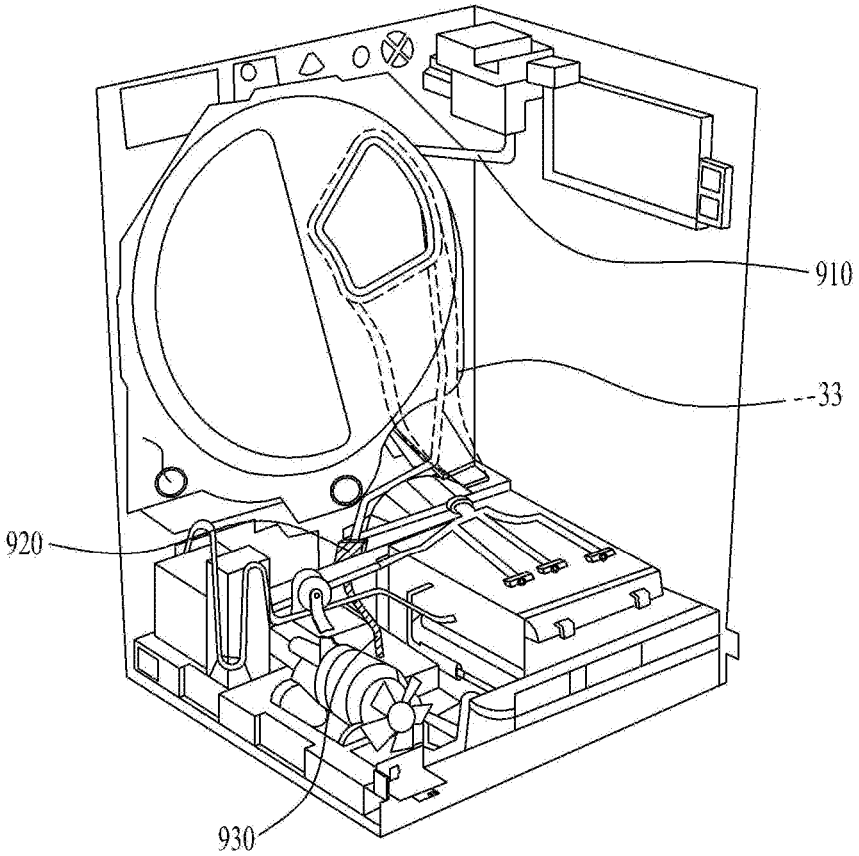
FIG. 13 shows another arrangement structure of a sterilizer.

FIG. 13 shows another structure of the sterilizer 900 of the laundry treating apparatus of the present disclosure.

At least a portion of the sterilizer 900 may be disposed in front or at the rear of the drum 2. Therefore, the effect that the sterilizer 900 may receive from the rotation of the drum 2 may be minimized.

In the laundry treating apparatus of the present disclosure, the air supply duct 33 may be connected to the second support 19. The air supply duct 33 is provided to extend from the connection duct 35 to the air inlet 198. Because the air inlet 198 is disposed at a position corresponding to the rear face of the drum 2, the air supply duct 33 extends upward from the base 39.

Accordingly, the air supply duct 33 may be disposed closest to the steam supplier 200, but may not be affected by the rotating drum 2. That is, the position of the air supply duct 33 may not be changed even when the drum 2 rotates.

Accordingly, the sterilizer 900 may be provided to extend along the air supply duct 33 to the circulating flow passage 3. Specifically, the supply pipe 910 may be provided to extend into the circulating flow passage 3 along an extending direction of the air supply duct 33.

In addition, the supply pipe 910 may be introduced into the air supply duct 33 and extended to the duct 3. In this case, a distal end of the supply pipe 910 or the sterilization pipe 920 may protrude to the outside of the air supply duct 33.

In addition, the sterilizer 900 may extend to the duct 3 along a rear face of the second support 19. Because the rear face of the second support 19 and the inner face of the rear panel 12 are not affected by the rotating drum 2, an optimum space in which the sterilizer 900 may be installed may be defined.

The high-temperature pipe 910 may be disposed between the air supply duct 33 and the cabinet 1. The supply pipe 910 may extend along a rear face of the air supply duct 33 to extend to the duct 3. The sterilization valve 920 may be seated at the rear of the connection duct 35.

The sterilization valve 920 may be disposed adjacent to the rear panel 12 than the front panel 11, and may be fixed at a position at the rear of the duct 3.

The sterilization pipe 930 may be disposed at the rear of the duct 3 or at the rear panel 12 to extend to a space spaced downwardly apart from the drum Therefore, the sterilizer 900 may be prevented from interfering with the drum 2.

Figure 14:
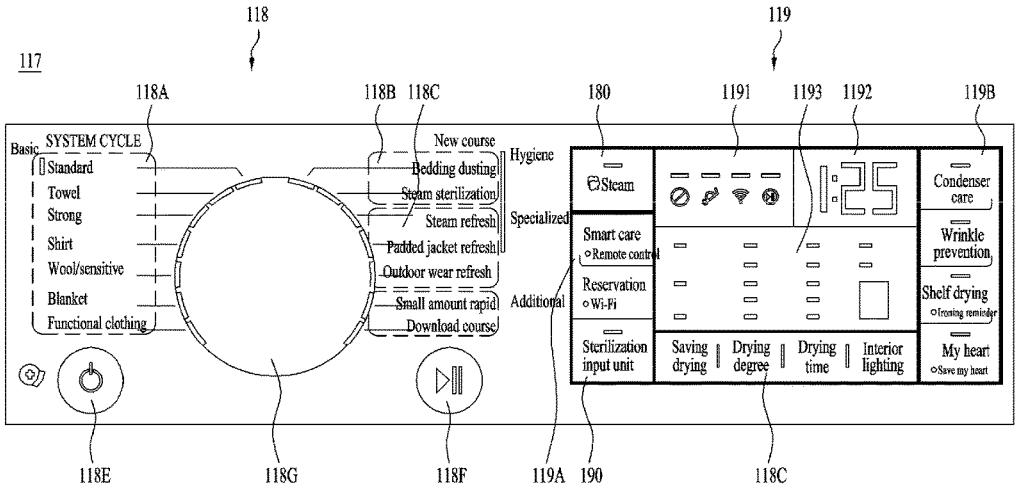
FIG. 14 shows a structure of a control panel of a laundry treating apparatus of the present disclosure.

FIG. 14 shows the control panel 117 of the laundry treating apparatus of the present disclosure.

The control panel 117 may include the input unit 118 for inputting the command for performing the drying process to the main controller, and the display 119 for externally displaying a state of the laundry treating apparatus.

The main controller may be built in the control panel 117. The main controller may be configured to control the heat-exchanger 4 and the driver 28, and may be configured to transmit a compatible signal to the steam controller 800.

In the main controller, an arbitrary course or option capable of performing the drying process may be pre-stored. The arbitrary course or option may be selected by an input from the input unit 118. The input unit 118 may be configured as any component as long as the input unit 118 is configured to receive an input for the main controller to perform one of the arbitrary course and option. The input unit 118 may be in a form of a knop, or may be in a form of a plurality of buttons.

The input unit 118 may include a course input unit 118A for selecting a course for performing a plurality of drying processes, a hygiene course input unit 118B capable of performing the sterilization of the laundry and the like, a specialized course input unit 118*c* capable of performing a refresh of the laundry, and additional course input unit configured to receive a special command, and may include a button or a knop 118G corresponding to the courses.

A component that receives a command for controlling the heat-exchanger or the driver, like the course input unit, the hygiene course input unit, and the specialized course input unit, may be collectively referred to as a process input unit.

The course for performing the plurality of drying processes may include a standard course for drying an average amount of laundry of an average material, a towel course for drying a towel with a high moisture content, a strong course for drying laundry with a high moisture content or a large amount of laundry, a shirt course for drying a small amount of laundry, a wool course for drying soft laundry, a blanket course for drying the large amount of laundry or a blanket, and a functional course for drying laundry of a waterproof material or the like.

In addition, the hygiene course may include a bedding dusting course, a steam sterilization course, or the like for supplying the high-temperature hot air and the steam into the drum 2 while rotating the drum 2.

In addition, the specialized course may include various refresh courses for removing odor of the laundry and dusting the foreign matters such as fine dust by rotating the drum while supplying the steam and the hot air to the laundry.

In addition, the additional course may be configured to receive a command for commanding a separate course or an update course provided by a server or the like.

The input unit 118 may include a power supply unit 118E configured to supply power to the main controller or supply power to the control panel 117, and an operation unit 118F for executing the arbitrary course or option when the arbitrary course or option is selected, or stopping the executed course or option.

In one example, the display 119 may be configured as a display panel to externally display the state of the laundry treating apparatus.

The display 119 may include an icon unit 1191 that may intuitively display a communication state or an operation state of the laundry treating apparatus, a time unit 1192 that may display a remaining time of the course being performed, and an option display 1193 that may display a detailed option history such as an intensity of the course being performed, the number of repetitions, or the like.

The control panel 117 may further include a separate input unit configured for the laundry treating apparatus to receive an additional command input.

The display 119 may be configured as a touch panel and may also serve as the separate input unit. In addition, the separate input unit may be configured as a button capable of receiving a separate command on an outer peripheral surface of the display panel.

For example, the separate input unit may include a remote control unit 119A for performing a communication connection to remotely control the steam supplier 180 that commands the supply of the steam in the arbitrary course, and the laundry treating apparatus with an external terminal, a condenser care unit 119B for cleaning the heat-exchanger 4, and an option selection unit 119C configured to receive one or more of commands capable of turning on lighting installed on the drum or the door so as to identify a power usage, a dryness, a course execution time, or the interior of the drum in the set course.

In addition, the control panel 117 may further include a sterilization input unit 190 capable of operating the sterilizer 900.

Therefore, the laundry treating apparatus of the present disclosure may be provided such that the user may arbitrarily sterilize the region outside the drum 2 through the input of the sterilization input unit 190 regardless of whether the course or the option is performed.

Figure 15:
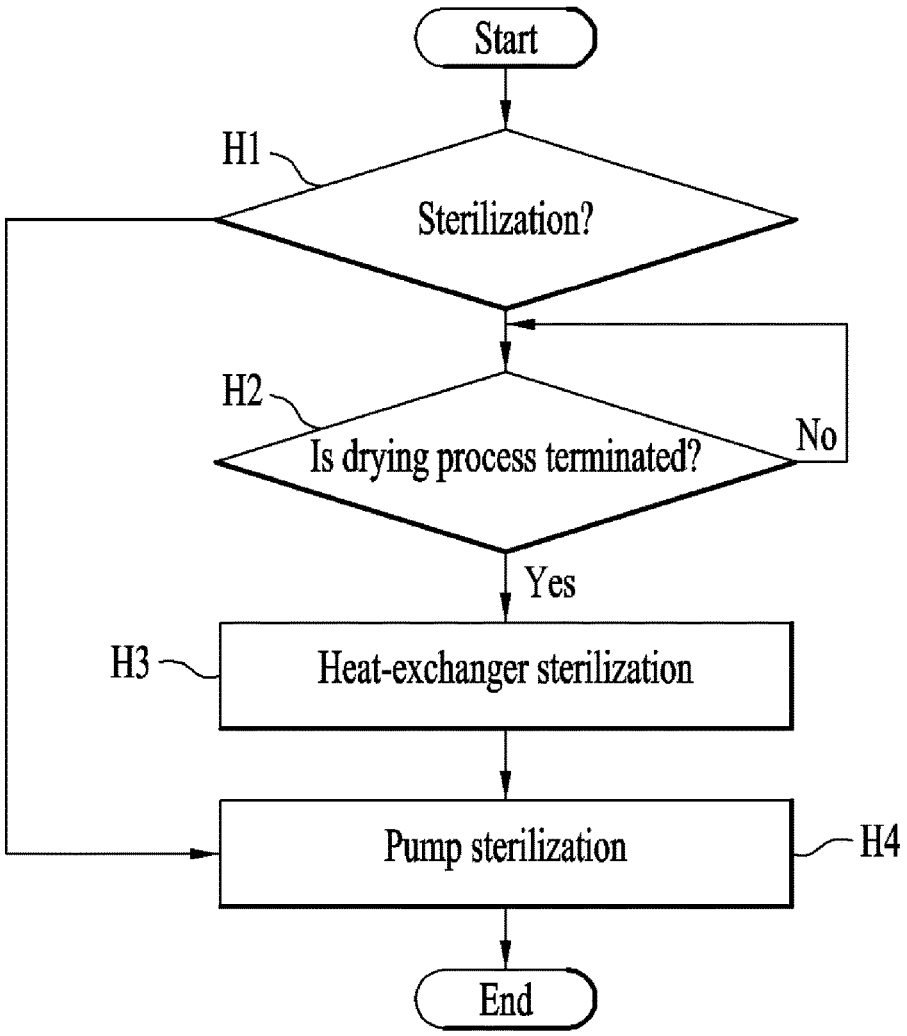
FIG. 15 shows an embodiment of a time point for performing sterilization of a sterilizer of the present disclosure.

FIG. 15 illustrates a control method for a scheme for operating the sterilizer 900 of the present disclosure.

The laundry treating apparatus of the present disclosure may be provided to sterilize the region outside the drum 2 with the sterilizer 900 by the input of the sterilization input unit 190. That is, when the sterilization input unit 190 receives the input, the water may be immediately supplied to the steam supplier 200 regardless of whether the laundry treating apparatus has performed the drying process, so that the region outside of the drum 2 may be sterilized.

Therefore, even when the moisture remains in the water collector 37 or the like for a long time and the bacteria propagate after the drying process is terminated, the interior of the cabinet may be sterilized with the sterilizer 900. Therefore, when performing the drying process, contamination of the laundry by the bacteria, the odors, or the like may be prevented.

Accordingly, the laundry treating apparatus of the present disclosure may perform a sterilization operation H1 for sensing whether the input of the sterilization input unit 190 is sensed.

When the input of the sterilization input unit 190 is sensed in the sterilization operation H1, the water may be supplied to the steam supplier 200, so that the high-temperature water or the steam may be discharged to the sterilizer 900.

In this connection, a pump sterilization operation H4 in which the sterilizer 900 sterilizes the washing pump 61 or the water collector 37, not the heat-exchanger 4, may be performed. In general, when the sterilization input unit 190 receives the input, the drying process is not being performed. Because the water condensed in the heat-exchanger 4 is collected in the water collector 37, it may not be necessary to forcefully sterilize the heat-exchanger 4. Therefore, when the sterilization input unit 190 receives the input, it is preferable to omit the sterilization of the heat-exchanger 4, and immediately supply the high-temperature water or the steam to the washing pump 61 or the water collector 37. Therefore, the washing pump 61 and the water collector 37 may be sterilized with a small amount of water without heat loss.

The sterilizer 900 may supply the water to the pump sterilization pipe 391.

In one example, when the input of the sterilization input unit 190 is not sensed in the sterilization operation H1, after the drying process is performed, a termination sensing operation H2 for sensing whether the drying process is terminated may be performed.

The termination detection operation H2 may be performed when the drying process starts. That is, the termination detection operation H2 may be an operation of sensing the termination of the drying process in a situation in which the drying process is being performed, rather than sensing a state in which the drying process is terminated itself.

The termination detection operation H2 may be performed after the administration input unit receives the input. That is, when the administration input unit receives the input, the termination detection operation H2 may sense when the driving of the fan, the driver, the heat-exchanger, or the like is terminated.

When the drying process is terminated and the driving of the fan, the driver, the heat-exchanger, or the like is terminated in the termination detection operation H2, the water may be supplied to the steam supplier 200, so that the high-temperature water or the steam may be discharged to the sterilizer 900.

In this connection, the heat-exchanger sterilization operation H3 in which the sterilizer 900 sterilizes the heat-exchanger 4 may be performed. When the drying process is terminated after being performed, not only the moisture discharged from the laundry but also the condensed water may remain in the heat-exchanger. Accordingly, the heat-exchanger sterilization operation H3 may prevent the bacterial propagation in the water collector 37 and the water storage 7 by the sterilization starting from the heat-exchanger itself.

The sterilizer 900 may sterilize the heat-exchanger 4 by directly supplying the high-temperature water or the steam to the switch sterilization pipe 933 or the heat sterilization pipe 932.

When the heat-exchanger sterilization operation H3 is terminated, the laundry treating apparatus may perform the pump sterilization operation H4 thereafter to also complete the sterilization of the water collector 37.

In one example, in the heat-exchanger sterilization operation H3, the sterilizer 900 may supply the high-temperature water or the steam to the pump sterilization pipe 931, and the washing pump 61 may be driven to flow the high-temperature water or the steam to the flow passage switcher 63 to sterilize the heat-exchanger 4.

That is, the sterilizer 900 may be controlled to primarily sterilize the heat-exchanger 4 using the washing pump 61 and the flow passage switcher 63.

When the heat-exchanger sterilization operation H3 is terminated, the pump sterilization operation H4 may be performed.

In one example, when the pump sterilization operation H4 is terminated, the washing pump 61 and the flow passage switcher 63 are controlled to supply the high-temperature water or the steam to the water storage 7. Therefore, the sterilization may be completed up to the water storage 7.

As a result, the sterilizer 900 may be provided to sterilize all of the duct 3, the heat-exchanger 4, the water collector 37, and the washer 6 through the washing pump 61.

In one example, the sterilizer 900 may be provided to sterilize one of the washing pump 61, the heat-exchanger 4, the duct 3, the washer 6, and the water collector 37.

The sterilizer 900 may be controlled to sterilize the washing pump 61 and the washer 6 or the water collector 37 after first sterilizing the heat-exchanger 4, and may be controlled to sterilize the washing pump 61 and the water collector 37 while omitting the sterilization of the heat-exchanger 4 when the heat-exchanger 4 does not operate.

As a result, the sterilizer 900 may be controlled to supply the heated water or the steam to the water collector 37 or the water storage 7 when the supply of the heated water or the steam to the washer 6 is terminated.

In addition, the sterilizer 900 may be configured to supply the heated water or the steam to the water collector 37 or the water storage 7 when the driving of the fan and the heat-exchanger is terminated when the input is received from the process input unit, so that the heat-exchanger 4 may be controlled to be washed first through the washing pump 61.

In addition, the sterilizer 900 may be controlled to supply the heated water or the steam to the water collector 37 or the water storage 7 when the input is received from the sterilization input unit 190. In this connection, the sterilizer 900 may be controlled to block the supply of the heated water or the steam to the heat-exchanger 4 when the input is received from the sterilization input unit 190.

The laundry treating apparatus and the control method of the laundry treating apparatus as above-described may be modified and implemented in various forms, and the scope of the disclosure is not limited to the above-described embodiments.

What is claimed is:

1. A laundry treating apparatus comprising:

a cabinet;

a drum disposed in the cabinet and configured to accommodate laundry therein;

a circulating flow passage configured to supply air discharged from the drum into the drum;

a heat-exchanger disposed inside the circulating flow passage and configured to condense moisture in the air or to heat the air;

a steam supplier configured to heat water and to generate steam, the steam supplier being configured to supply the steam into the drum or the circulating flow passage; and a sterilizer connected to the steam supplier and configured to supply the heated water or the steam from the steam supplier to a region outside the drum.

2. The laundry treating apparatus of claim 1, wherein the sterilizer comprises:

a high-temperature pipe that extends from the steam supplier;

a sterilization valve configured to open and close the high-temperature pipe; and a sterilization pipe that extends from the sterilization valve and is configured to discharge the heated water or the steam to the region outside the drum.

3. The laundry treating apparatus of claim 2, wherein the sterilization valve is configured to block the steam and discharge the heated water through the sterilization pipe.

4. The laundry treating apparatus of claim 3, wherein the sterilization valve is configured to open the high-temperature pipe based on a temperature of the heated water in the high-temperature pipe being greater than or equal to a sterilization temperature.

5. The laundry treating apparatus of claim 3, wherein the sterilization valve is configured to close the high-temperature pipe based on the steam or vapor being carried along the high-temperature pipe.

6. The laundry treating apparatus of claim 1, wherein the sterilizer is spaced apart from an outer surface of the drum.

7. The laundry treating apparatus of claim 6, wherein at least a portion of the sterilizer is fixed to the cabinet or the circulating flow passage.

8. The laundry treating apparatus of claim 7, wherein the sterilizer comprises:

a high-temperature pipe that extends from the steam supplier, wherein at least a portion of the high-temperature pipe is fixed to the cabinet;

a sterilization valve configured to open and close the high-temperature pipe; and a sterilization pipe that extends from the sterilization valve and is configured to discharge the heated water or the steam to the region outside the drum.

9. The laundry treating apparatus of claim 8, wherein at least a portion of the sterilization pipe is supported on the circulating flow passage.

10. The laundry treating apparatus of claim 6, wherein the sterilizer comprises:

a high-temperature pipe that extends from the steam supplier;

a sterilization valve coupled to an inner surface of the cabinet and configured to open and close the high-temperature pipe; and a sterilization pipe that extends from the sterilization valve and is configured to discharge the heated water or the steam to the region outside the drum.

11. The laundry treating apparatus of claim 10, wherein the cabinet comprises a gripping portion that fixes the high-temperature pipe to the cabinet at a position spaced apart from the drum.

12. The laundry treating apparatus of claim 6, wherein at least a portion of the sterilizer is disposed at a rear side of the drum or disposed forward relative to the rear side of the drum.

13. The laundry treating apparatus of claim 12, wherein the circulating flow passage comprises:

an air discharge duct in communication with a front side of the drum;

a connection duct that is connected to the air discharge duct and that accommodates the heat-exchanger; and an air supply duct that is connected to the connection duct and in communication with the rear side of the drum, and wherein at least a portion of the sterilizer is disposed within the air supply duct or between the air supply duct and the cabinet.

14. The laundry treating apparatus of claim 13, wherein the sterilizer comprises:

a high-temperature pipe that extends from the steam supplier and is disposed between the air supply duct and the cabinet;

a sterilization valve disposed at a rear region of the connection duct and configured to open and close the high-temperature pipe; and a sterilization pipe that extends from the sterilization valve and configured to discharge the heated water or the steam to the region outside the drum.

15. The laundry treating apparatus of claim 13, wherein the sterilizer is disposed between the air supply duct and the cabinet.

16. The laundry treating apparatus of claim 1, further comprising:

a water collector that is in communication with the circulating flow passage and configured to collect condensed water from the heat-exchanger; and a water storage configured to receive the condensed water from the water collector and to discharge the condensed water out of the cabinet, wherein the sterilizer is configured to supply the heated water or the steam to at least one of the water collector or the water storage.

17. The laundry treating apparatus of claim 16, further comprising a washer configured to supply the water collected in the water collector to the heat-exchanger to thereby wash the heat-exchanger, wherein the sterilizer is in communication with the washer and configured to supply the heated water or the steam to the washer.

18. The laundry treating apparatus of claim 17, wherein the washer comprises:

a washing pump configured to provide power to supply the water collected in the water collector to the heat-exchanger or the water storage;

a flow passage switcher configured to provide the water supplied from the washing pump to at least one of the heat-exchanger or the water storage; and a sprayer configured to supply the water from the flow passage switcher to the heat-exchanger, and wherein the sterilizer is configured to supply the heated water or the steam to at least one of the washing pump, the flow passage switcher, or the sprayer.

19. The laundry treating apparatus of claim 18, wherein the sterilizer comprises:

a high-temperature pipe that extends from the steam supplier;

a sterilization valve configured to open and close the high-temperature pipe; and a sterilization pipe that extends from the sterilization valve to at least one of the water collector, the flow passage switcher, or the sprayer.

20. The laundry treating apparatus of claim 1, further comprising an input unit coupled to the cabinet and configured to receive a command from a user, wherein the input unit is configured to receive a sterilization input for operating the sterilizer while the heat-exchanger is stopped.

* * * * *